US007656419B2

(12) United States Patent
Hashimoto

(10) Patent No.: US 7,656,419 B2
(45) **Date of Patent: *Feb. 2, 2010**

(54) DRIVE CIRCUIT FOR DISPLAY APPARATUS AND DISPLAY APPARATUS

(75) Inventor: Yoshiharu Hashimoto, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/230,933

(22) Filed: Sep. 8, 2008

(65) Prior Publication Data

US 2009/0040245 A1 Feb. 12, 2009

Related U.S. Application Data

(62) Division of application No. 11/079,223, filed on Mar. 15, 2005.

(30) Foreign Application Priority Data

Mar. 16, 2004 (JP) ..... 2004-073741
Sep. 9, 2004 (JP) ..... 2004-262191
Jan. 25, 2005 (JP) ..... 2005-016518

(51) Int. Cl.
*G09G 5/10* (2006.01)

(52) U.S. Cl. ..... 345/690; 345/98

(58) Field of Classification Search ..... 345/87, 345/94–96, 98–100, 103, 204, 690
See application file for complete search history.

(56) References Cited

U.S. PATENT DOCUMENTS 4,999,618 A * 3/1991 Inada et al. ..... 345/79
6,121,943 A * 9/2000 Nishioka et al. ..... 345/76
6,266,039 B1 * 7/2001 Aoki ..... 345/94

(Continued)

FOREIGN PATENT DOCUMENTS

CN 1350279 A 5/2002

(Continued)

OTHER PUBLICATIONS

Korean Office Action dated Jul. 31, 2006, with partial English translation.

(Continued)

*Primary Examiner*—Ricardo L Osorio
(74) *Attorney, Agent, or Firm*—McGinn IP Law Group, PLLC

(57) ABSTRACT

A drive circuit that is an example of the present invention is a drive circuit of a display device for outputting in parallel the analog picture signals generated based on the digital picture signals inputted in serial. This circuit comprises a level shift circuit for converting the voltage level of the digital picture signals that were inputted in serial, a D/A conversion circuit for generating analog picture signals based on the digital picture signals that were subjected to level conversion with the level shift circuit, and an expansion circuit connected to the output side of the D/A conversion circuit or between the level shift circuit and the D/A conversion circuit and serving to expand and hold the inputted serial picture signals in parallel and output the picture signals in parallel. The level shift circuit is thus formed in the front stage of the picture signal register circuit.

3 Claims, 43 Drawing Sheets

U.S. PATENT DOCUMENTS

| | | | | |
|---|---|---|---|---|
| 6,392,354 | B1 | 5/2002 | Matsueda | |
| 6,518,708 | B2 | 2/2003 | Aso | |
| 6,853,362 | B2 | 2/2005 | Bu | |
| 7,053,690 | B2 * | 5/2006 | Utsuno | 327/407 |
| 7,098,881 | B2 * | 8/2006 | Nitta et al. | 345/89 |
| 7,265,602 | B2 * | 9/2007 | Utsuno | 327/407 |
| 2002/0074948 | A1 | 6/2002 | Aso | |
| 2004/0080522 | A1 * | 4/2004 | Nitta et al. | 345/690 |
| 2006/0006928 | A1 * | 1/2006 | Utsuno | 327/541 |
| 2006/0087484 | A1 * | 4/2006 | Kumeta et al. | 345/96 |
| 2006/0232539 | A1 | 10/2006 | Hashimoto | |
| 2006/0238473 | A1 | 10/2006 | Hashimoto | |

FOREIGN PATENT DOCUMENTS

| | | |
|---|---|---|
| JP | 10-62744 | 3/1998 |
| KR | 10-0463817 | 5/2002 |

OTHER PUBLICATIONS

U.S. Office Action dated Dec. 19, 2008.
Chinese Office Action dated Dec. 5, 2008 with English Translation.

* cited by examiner

CONVENTIONAL ART

CONVENTIONAL ART

| R | G | B | R | G | B |
|---|---|---|---|---|---|
| + | − | + | − | + | − |
| − | + | − | + | − | + |
| + | − | + | − | + | − |
| − | + | − | + | − | + |
| + | − | + | − | + | − |
| − | + | − | + | − | + |

SWITCH EVERY FRAME

| R | G | B | R | G | B |
|---|---|---|---|---|---|
| − | + | − | + | − | + |
| + | − | + | − | + | − |
| − | + | − | + | − | + |
| + | − | + | − | + | − |
| − | + | − | + | − | + |
| + | − | + | − | + | − |

FIG. 2

CONVENTIONAL ART

| R | G | B | R | G | B |
|---|---|---|---|---|---|
| + | − | + | − | + | − |
| + | − | + | − | + | − |
| − | + | − | + | − | + |
| − | + | − | + | − | + |
| + | − | + | − | + | − |
| + | − | + | − | + | − |

SWITCH EVERY FRAME

| R | G | B | R | G | B |
|---|---|---|---|---|---|
| − | + | − | + | − | + |
| − | + | − | + | − | + |
| + | − | + | − | + | − |
| + | − | + | − | + | − |
| − | + | − | + | − | + |
| − | + | − | + | − | + |

FIG. 3

CONVENTIONAL ART

CONVENTIONAL ART

STB=L, POL=H

STB=L, POL=L

STB=H

CONVENTIONAL ART

| | R1 | G1 | B1 | R2 | G2 | B2 |
|---|---|---|---|---|---|---|
| X1 LINE | + | − | + | − | + | − |
| X2 LINE | − | + | − | + | − | + |

STB=L, POL=H

STB=L, POL=L

STB=H

| POWER SOURCE NAME | VOLTAGE |
|---|---|
| VDD | 2. 5V |
| VSS | 0V |
| VPH | 5V |
| VPL | 0V |
| VNH | 0V |
| VNL | −5V |

| LAYER NAME | VOLTAGE |
|---|---|
| Psub | −5V |
| Nwell−1 | 5V |
| Nwell−2 | 0V |
| Nwell−3 | 5V |
| Nwell−4 | 2. 5V |

FIG. 25

STB=L、POL=H

STB=H、POL=L

STB=L、POL=L

STB=H、POL=H

STB=L、POL=H

STB=H、POL=L

STB=L、POL=L

STB=H、POL=H

DRIVE CIRCUIT FOR DISPLAY APPARATUS AND DISPLAY APPARATUS

The present application is based on Japanese patent applications Nos. 2004-073741, 2004-262191, and 2005-016518, the entire contents of which are incorporated herein by reference.

The present Application is a Divisional Application of U.S. patent application Ser. No. 11/079,223, filed on Mar. 15, 2005.

BACKGROUND OF THE INVENTION

1. Field of the Invention

The present invention relates to a drive circuit of a display device and to a display device, and more particularly to a drive circuit suitable for liquid crystal display devices with a dot inversion drive.

2. Description of the Related Art

Liquid crystal displays are employed as displays for various lightweight and thin electronic devices with low power consumption, such as cellular phones. As liquid crystal displays, a simple matrix type and an active matrix type (AM-LCD: Active Matrix Liquid crystal display) using active elements such as TFTs (Thin Film Transistors) in a pixel circuit are known.

FIG. 1 is a block diagram of a well-known liquid crystal display. The liquid crystal display comprises a scanning line drive circuit 2, a liquid-crystal panel 3, a control circuit 7, a data line drive circuit 51, a power source circuit 58, and a common voltage generation circuit 59. Picture signals, vertical synchronization signal Vsync, horizontal synchronization signal Hsync, and dot clock signal dCLK are inputted into the control circuit 7. Power source voltages of VDC and GND are supplied to the power source circuit 58. Gate electrodes of all TFT are connected to the scan lines 5 extending in the row direction, and drain (source) electrodes are connected to the data lines 4 extending in the column direction. Display signals from the data line drive circuit 51 that is controlled by the control circuit 7 are provided to each data lines 4. In such a liquid crystal display, the scanning line drive circuit 2 scans the scanning lines 5 in turn according to the control signals from the control circuit 7, thereby displaying one image on the display (line consecutive method). This one image is called a frame (field).

In the conventional liquid crystal display, the polarity of the voltage applied from the data lines 4 to the pixels via TFT (referred to hereinbelow as "pixel voltage") is inverted at prescribed periods. In other words, the pixels are AC driven. The term "polarity" used herein indicates whether the pixel voltage is positive or negative with respect to a voltage of a common electrode (com voltage) as a reference. Such a drive method is employed to inhibit the degradation of liquid-crystal material. For example, a dot inversion drive method in which the polarity of pixel voltage is inverted every adjacent data line and scanning line so that the polarity is different for the adjacent pixels, as shown in FIG. 2, and a two-line-dot inversion drive method in which the polarity is inverted for each adjacent data line and every two scanning lines, as shown in FIG. 3, are known. With such drive methods, flickering and other defects are decreased and image quality is improved. The configuration shown in FIG. 4 and described in Japanese Patent Application Laid-open No. 10-62744 has been suggested as a data line drive circuit 51 for realizing the dot inversion drive method. A data line drive circuit 51 comprises a shift register circuit 61, a data register circuit 62, a data latch circuit 63, a switching circuit A 64, a level shift circuit P 65, a level shift circuit N 66, a D/A conversion circuit P 67, a D/A conversion circuit N 68, a switching circuit B 69, a signal processing circuit 70, a positive gradation voltage generation circuit 71, and a negative gradation voltage generation circuit 72. A latch signal STB and a polarity signal POL are inputted into the signal processing circuit 70. A horizontal start signal STH and clock signal CLK are inputted into the shift register circuit 61. The switching circuit A 64 selects the picture signal so as to input it either into the positive polarity drive circuit or negative polarity drive circuit. Further, the switching circuit B 69 switches the outputs from the positive polarity drive circuit and negative polarity drive circuit so that the selected output corresponds to the picture signal.

The positive polarity drive circuit comprises a level shift circuit P 65 for level shifting the picture signal to the positive side with respect to the com voltage and the positive polarity D/A conversion circuit 67. The negative polarity drive circuit comprises a level shift circuit N 66 for level shifting the picture signal to the negative side with respect to the con voltage and the negative polarity D/A conversion circuit 68. A con voltage of 5 V, a positive polarity voltage of from 5V to 10V, and a negative polarity voltage of from 0V to 5V are disclosed as examples of each voltage setting. In this case, the con voltage, the voltage of the data line drive circuit, and the voltage of the scanning line drive are generated by the power source circuit 58.

FIG. 5 is a timing chart showing the relationship between the STB signal, POL signal, and outputs of adjacent data lines 4. As shown in FIG. 5, the polarity of adjacent data lines is inverted and the output of data lines for each frame is inverted. FIG. 6 is a detailed diagram of the switching circuit A 64 and switching circuit B69. It shows the switch state at each timing shown in FIG. 5. As can be understood from FIG. 5 and FIG. 6, the switching circuit A 64 and switching circuit B 69 conduct switching operation so that the output is inverted every line and frame to realize the dot inversion drive.

It has now been discovered that, however, this conventional drive circuit has several drawbacks. The first of them is the increase of circuitry scale. A level shift circuit is provided in each drive circuit corresponding to each data line. If the difference between the voltage inputted into the level shift circuit and the voltage to which the level is shifted is large, the circuitry scale is increased. Furthermore, in the level shift circuit, if the power source voltage is high, it is necessary to increase the breakdown voltage of the elements constituting the circuit. Accordingly, the gate oxide film Tox is made thick, the gate length L and gate width W are increased, and the distance between the elements is increased. As a result, the circuit surface area is increased.

Further, in the conventional drive circuit (FIG. 4), the picture signal of one scanning line is level shifted to a positive or negative side for every two adjacent signals after it has been latched in parallel in the data latch circuit 63. Therefore, if the picture signal is an n-bit signal and the number of data lines is m, then the number of required level shift circuits of each drive circuit is n×m.

Further, in the conventional drive circuit, the signals for every two adjacent signals is switched to a positive or negative level shift circuit 65, 66 after the digital picture signal of one scanning line has been latched in parallel in the data latch circuit 63. Therefore, the number of required switching circuits 64 for switching the digital picture signals is also n.times.m.

The second drawback is the large power consumption. If the com voltage is 5V, the high level voltage of about 10 V of positive polarity is generated in the power source circuit, as a result, the efficiency of the power source circuit decreases and power consumption increases. A charge pump structure composed of a plurality of capacitors and switches is employed in the power source circuit, and if a voltage of 10V is generated from 2.5V, the power source efficiency is from about 60% to 70%. The switches have a parasitic capacitor, and the power is consumed by this parasitic capacitor, thereby decreasing the efficiency. For example, when the voltage is increased from 2.5V to 5V, the efficiency is 80%, and when the voltage is increased from 5 V to 10V, the efficiency is similarly 80%, however, for the increase from 2.5 V to 10 V, the efficiency is 80%.times.80%=64%. If the power source voltage used for drive is high, then the number of voltage increase steps is increased, the efficiency of the power source circuit is decreased, and power consumption is increased.

SUMMARY OF THE INVENTION

According to one aspect of the invention, there is provided a drive circuit for a display apparatus outputting analog picture signals in parallel produced based on serial input digital picture signals. The drive circuit comprises a level shift circuit level shifting voltage levels of serially inputted digital picture signals, a D/A conversion circuit producing analog picture signals based on the digital picture signals level shifted by the level shift circuit, and an expansion circuit connected at an output side of the D/A conversion circuit or between the level shift circuit and the D/A conversion circuit for expanding and holding in parallel serially inputted picture signals and outputting the picture signals in parallel. Arranging the level shift circuit preceding to the D/A conversion circuit and the expansion circuit allows reduction of the circuit scale.

According to another aspect of the invention, there is provided a display apparatus comprising a display panel having a plurality of pixels and a drive circuit providing analog picture signals controlling brightness of the pixels. The drive circuit comprises a level shift circuit level shifting voltage levels of serially inputted digital picture signals, a D/A conversion circuit producing analog picture signals based on the digital picture signals level shifted by the level shift circuit, an expansion circuit connected at an output side of the D/A conversion circuit or between the level shift circuit and the D/A conversion circuit for expanding and holding in parallel serially inputted picture signals and outputting the picture signals in parallel.

According to another aspect of the invention, there is provided a drive circuit for a display apparatus outputting a positive polarity analog picture signal and a negative polarity analog picture signal with respect to a reference voltage to data lines of the display apparatus. The drive circuit comprises a positive polarity drive circuit formed in a first continuous area on a substrate for outputting the positive polarity analog picture signal, a negative polarity drive circuit formed in a second continuous area different from the first continuous area on the substrate for outputting the negative polarity analog picture signal, and a switching circuit formed in a third continuous area different from the first and the second continuous areas on the substrate and switching the positive polarity analog picture signal from the positive polarity drive circuit and the negative polarity analog picture signal from the negative polarity drive circuit. This element arrangement of invention allows the reduction of chip size.

According to another aspect of the invention, there is provided a display apparatus comprising a display panel having a plurality of pixels and a drive circuit providing the display panel with a positive polarity analog picture signal and a negative polarity analog picture signal with respect to a reference voltage. The drive circuit comprises a positive drive circuit, a negative drive circuit and a switching circuit. The positive drive circuit is formed in a first continuous area on a substrate, processes positive polarity digital picture signals, and D/A converts the positive polarity digital picture signals to output positive polarity analog picture signals. The negative drive circuit is formed in a first continuous area on a substrate, processes negative polarity digital picture signals and D/A converts the negative polarity digital picture signals to output negative polarity analog picture signals. The switching circuit switches outputs from the positive drive circuit and negative drive circuit.

According to another aspect of the invention, there is provided a drive circuit for a display apparatus outputting a positive polarity analog picture signal and a negative polarity analog picture signal with respect to a reference voltage to a data line of the display apparatus. The drive circuit comprises a positive polarity drive circuit outputting the positive polarity analog picture signal, a negative polarity drive circuit outputting the negative polarity analog picture signal, a switching circuit switching the positive polarity analog picture signal and the negative polarity analog picture signal to provide to the data line, a positive polarity pre-charge switch, formed between the positive polarity drive circuit and the switching circuit, capable of pre-charging the data line to a positive polarity pre-charge voltage before an analog signal provided to the data line is changed from the positive polarity to the negative polarity, and a negative polarity pre-charge switch, formed between the negative polarity drive circuit and the switching circuit, capable of pre-charging the data line to a negative polarity pre-charge voltage before an analog signal provided to the data line is changed from the negative polarity to the positive polarity. Since the positive and negative drive circuits have the pre-charge switch respectively, it is possible to fabricate the pre-charge switches of medium-voltage elements for reduction of circuit scale.

According to another aspect of the invention, there is provided a drive circuit for a display apparatus D/A converting an digital picture to provide an analog picture signal to a data line of the display apparatus. The drive circuit comprises a positive polarity drive circuit outputting the positive polarity analog picture signal with respect to system ground voltage, a negative polarity drive circuit outputting the negative polarity analog picture signal with respect to the system ground voltage, and a power supply circuit generating a DC voltage different from the system ground within between a high voltage of the positive polarity drive circuit and a low voltage of the negative polarity drive circuit to provide to a common electrode of the display apparatus. The common voltage allows the compensation for the feed-through error.

BRIEF DESCRIPTION OF THE DRAWINGS

The above and other objects, advantages and features of the present invention will be more apparent from the following description taken in conjunction with the accompanying drawings, in which:

FIG. 2 is a schematic diagram illustrating the polarity of each pixel in the dot inversion drive in the conventional technology;

FIG. 3 is a schematic diagram illustrating the polarity of each pixel in the 2-line-dot inversion drive in the conventional technology;

FIG. 25 is a power source voltage table of the first embodiment of the present invention;

DESCRIPTION OF THE PREFERRED EMBODIMENTS

Embodiment 1

Figure 1:
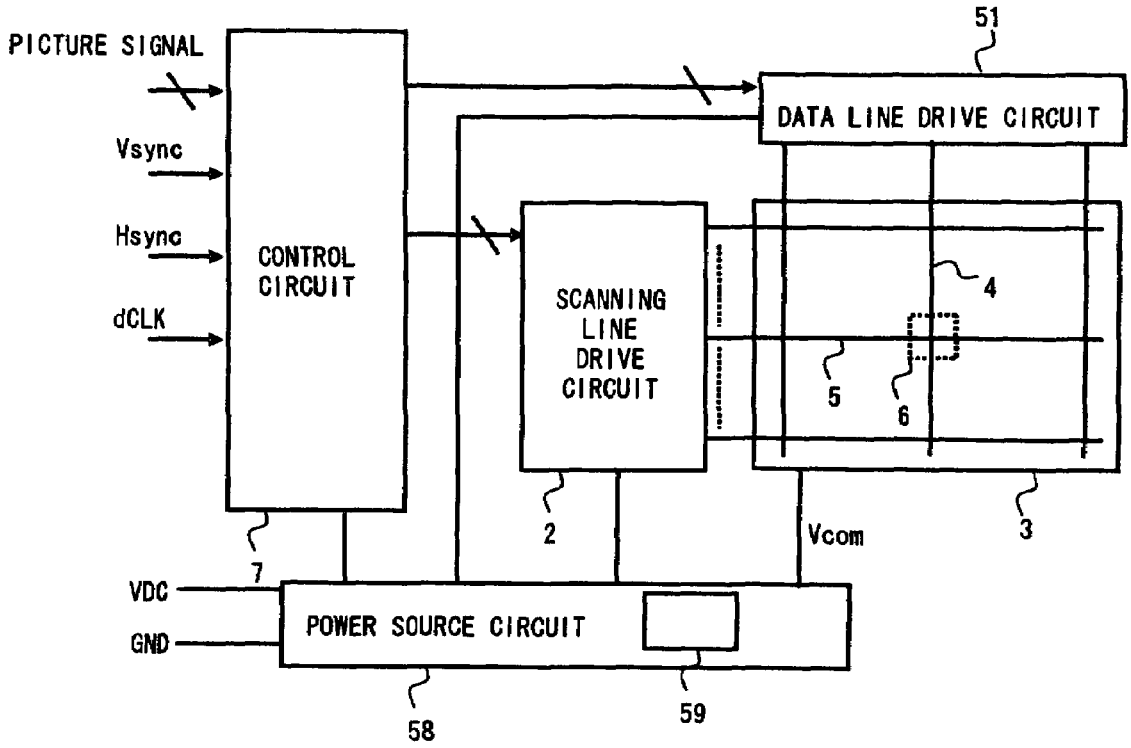
FIG. 1 is block diagram of the liquid crystal display device according to the conventional technology.
Figure 4:
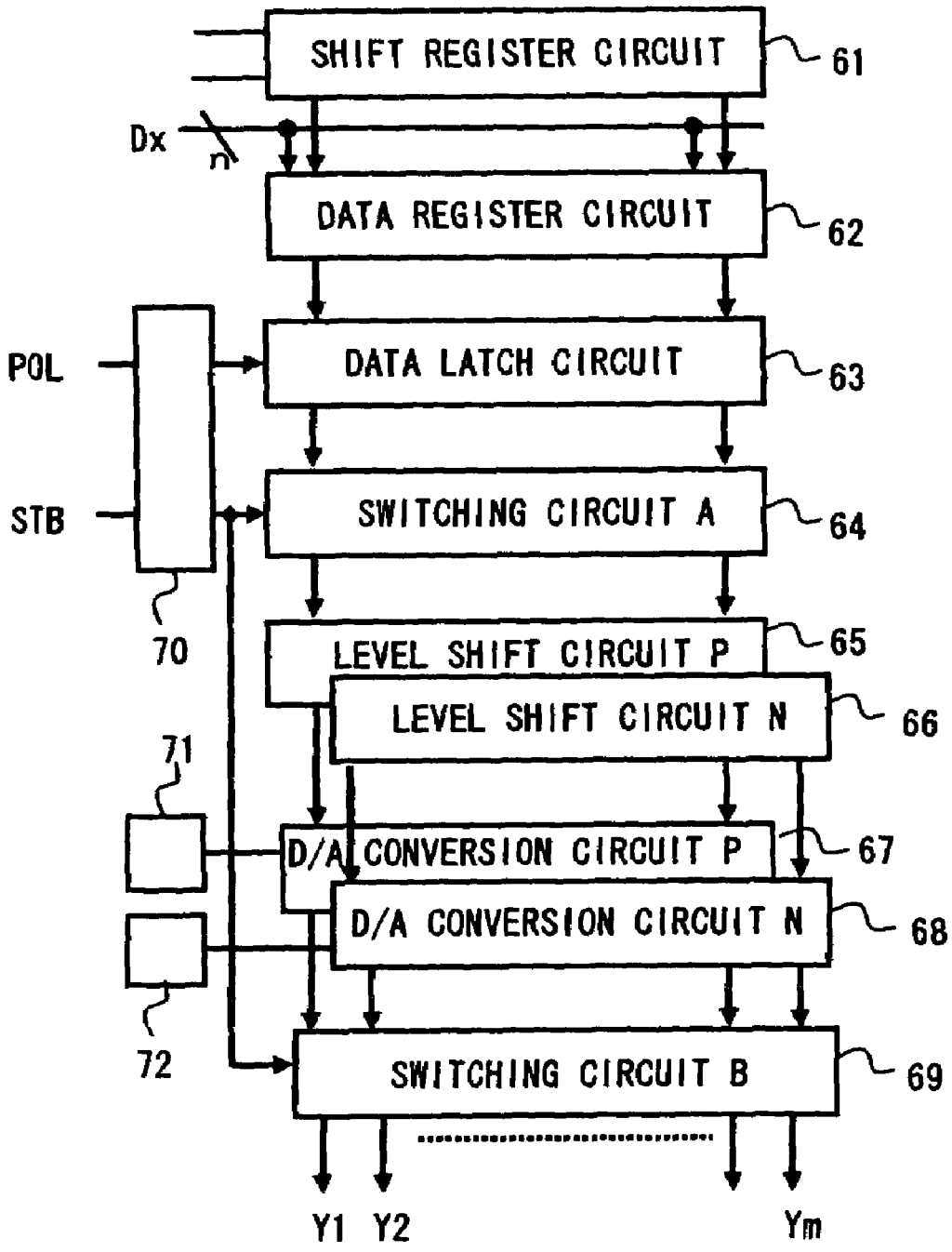
FIG. 4 is a block diagram of the data line drive circuit in the conventional technology.
Figure 5:
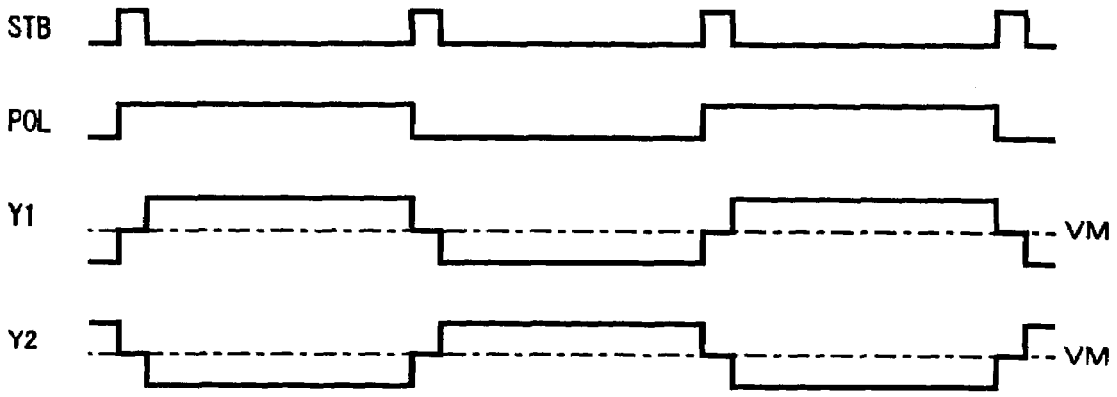
FIG. 5 is a timing chart of the data line drive circuit in the conventional technology.
Figure 6A:
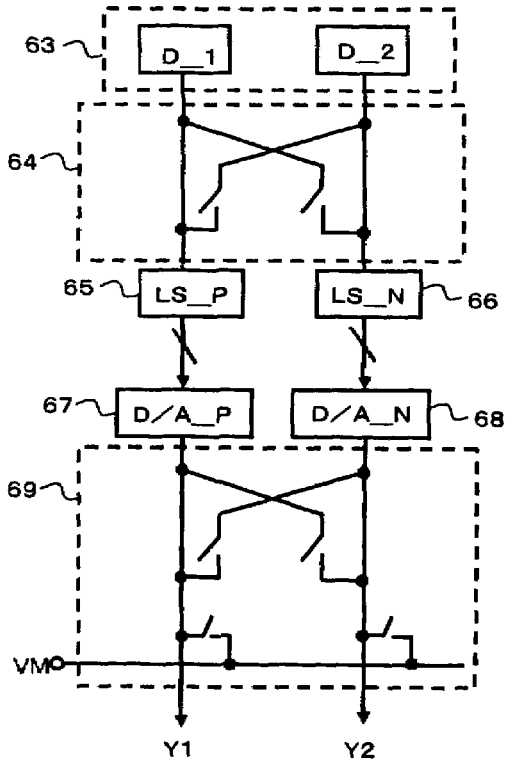
FIG. 6A-6C show switch states of the data line drive circuit in the conventional technology.
Figure 6B:
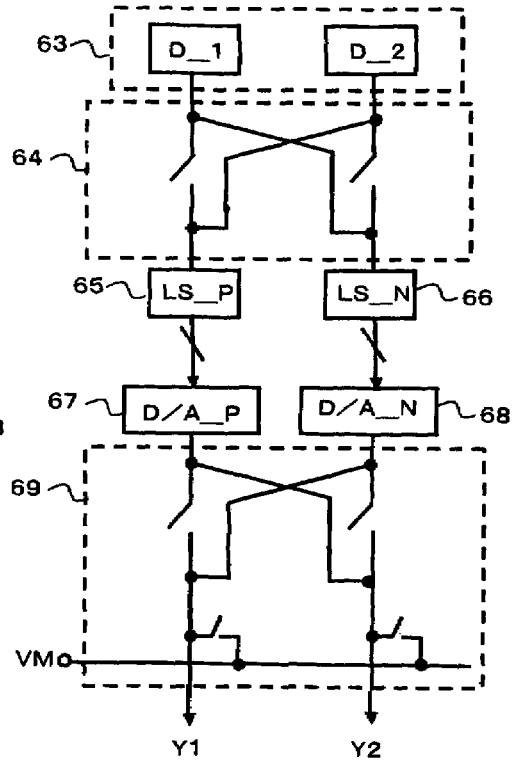
CONVENTIONAL ART FIG. 6B
Figure 6C:
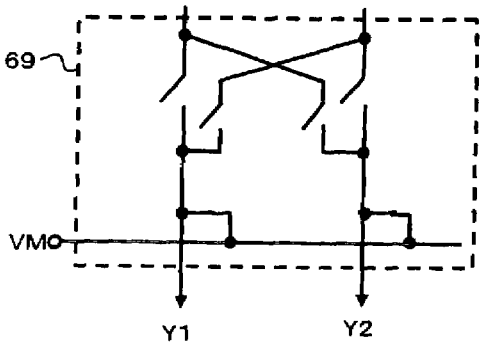
CONVENTIONAL ART FIG. 6C
Figure 7:
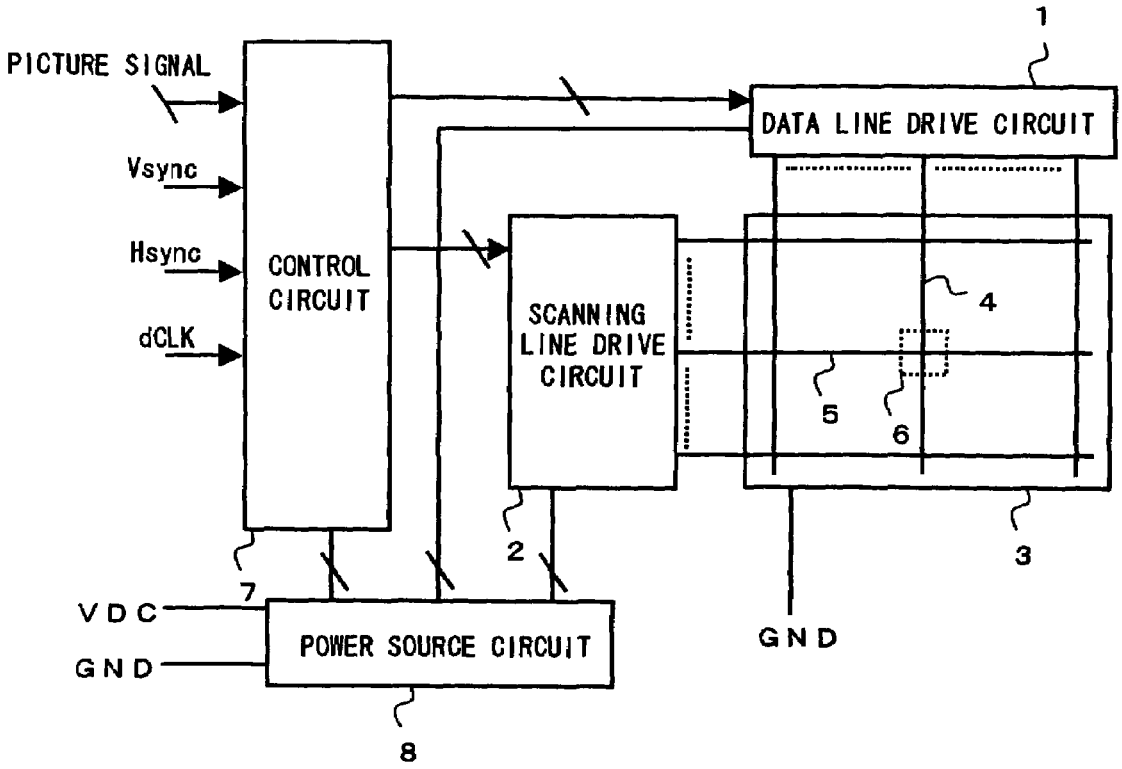
FIG. 7 is block diagram of the liquid crystal display device of the first embodiment of the present invention.

FIG. 7 is a block diagram of the liquid crystal display of the present embodiment. A plurality of data lines 4 and a plurality of scanning lines 5 arranged perpendicularly to the data lines 4—are formed on a liquid-crystal panel 3, and TFT (Thin Film Transistors) as switching elements and pixels 6 containing liquid crystals and the like are formed at the intersection points of the lines. A common electrode and a display electrode for applying an electric field to the liquid crystal are formed in a pixel.

An analog picture signal for controlling the brightness (quantity of transmitted light) of the pixel is supplied from the data line to the display electrode, and a com voltage (DC voltage) is supplied to the common electrode. Furthermore, the liquid crystal display comprises a data line drive circuit 1 for driving the data lines 4, a scanning line drive circuit 2 for driving the scanning lines 5, a control circuit 7 for controlling the data line drive circuit 1 and scanning line drive circuit 2, and a power source circuit 8 for supplying voltage to the control circuit 7, data line drive circuit 1, and scanning line drive circuit 2. The high-voltage voltage of the power source voltage supplied to the power source circuit 8 is a VDC and a low-voltage voltage is a system ground GND.

Figure 8:
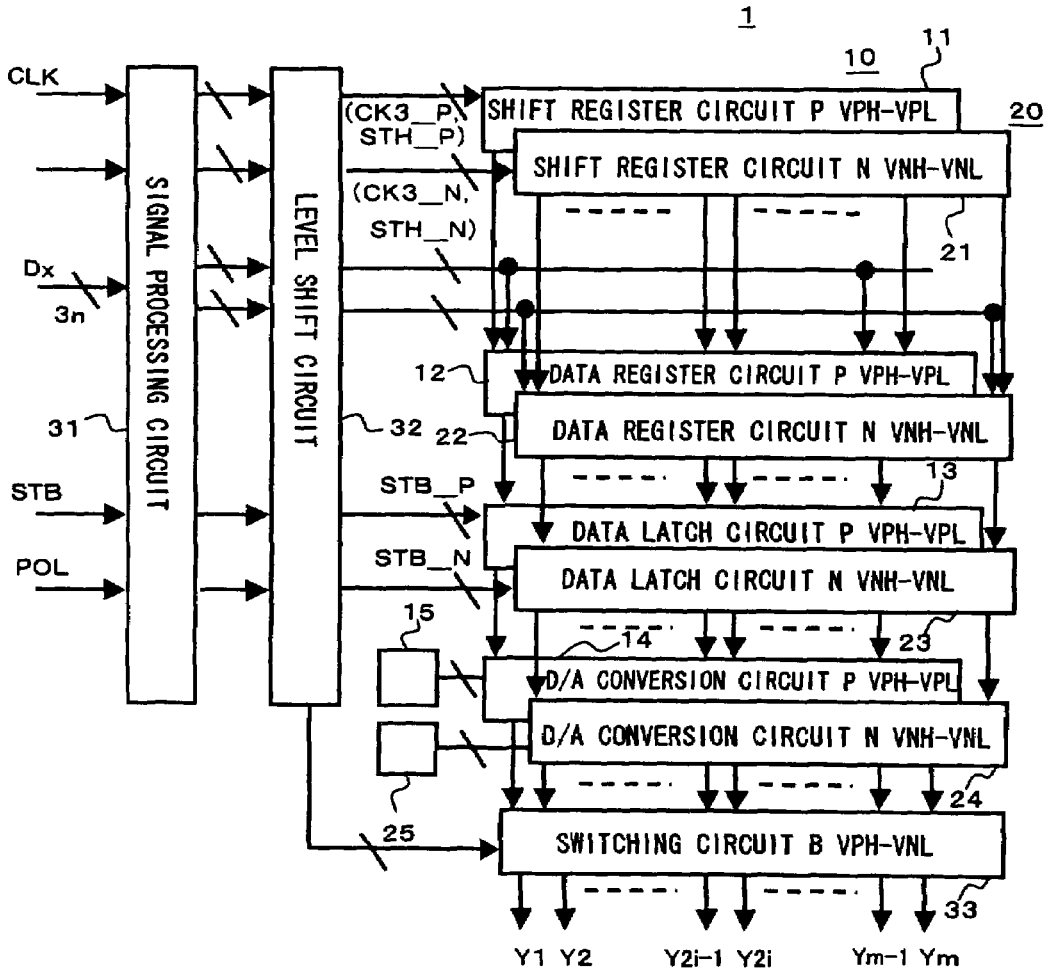
FIG. 8 is a block diagram of the data line drive circuit of the first embodiment of the present invention.

FIG. 8 is a block diagram of the data line drive circuit 1 in accordance with the present invention. The configuration and operation of each component of the circuit will be described below. The data line drive circuit 1 comprises shift register circuits 11, 21, data register circuits 12, 22, data latch circuits 13, 23, D/A conversion circuits 14, 24, gradation voltage generation circuits 15, 25, a signal processing circuit 31, a level shift circuit 32, and a switching circuit 33.

Figure 9:
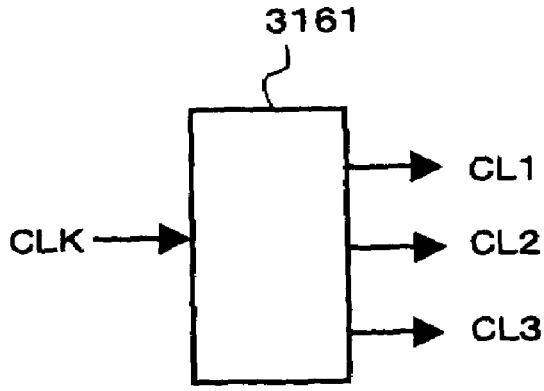
FIG. 9 is a clock generation circuit of the first embodiment of the present invention.
Figure 10:
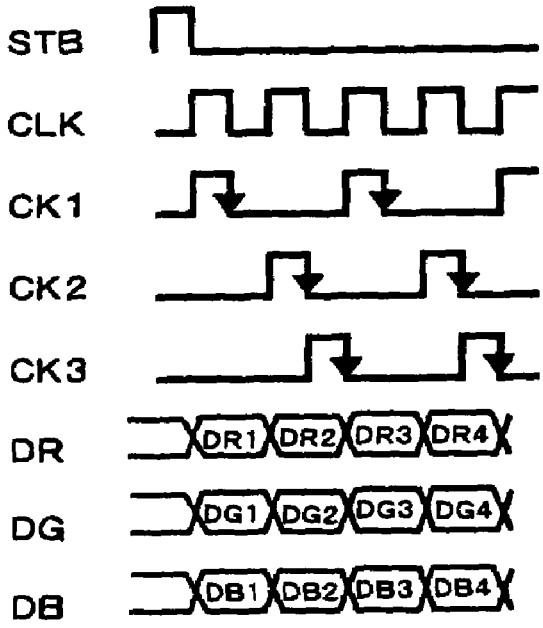
FIG. 10 is the timing chart of clock generation of the first embodiment of the present invention.

Signals inputted into the data line drive circuit 1 include a digital picture signal Dx (abbreviated hereinbelow as picture signal Dx), a clock signal CLK, a horizontal start signal STH, a latch signal STB, and a polarity signal POL. The desired timing signals are generated form those signals in the signal processing circuit 31, to control the below-described data latch signals 13, 23 or switching circuit 33. Furthermore, the signal processing circuit 31 comprises a clock generation circuit 3161 shown in FIG. 9. In the clock generation circuit 3161, a CK1 signal, a CK2 signal, and a CK3 signal synchronized with the clock signal CLK shown in FIG. 10 are generated from the clock signal CLK.

As for the picture signal Dx in a 64-gradation (6 bit) color liquid crystal display, a signal of 1 display element (3 pixels) consisting of a total 18 bit of DR (DR00, DR01, DR02, DR03, DR04, DR05), DG (DG00, DG01, DG02, DG03, DG04, DG05), DB (DB00, DB01, DB02, DB03, DB04, DB05), is inputted synchronously with the clock signal CLK. The explanation below will be provided with respect to a case where the picture signal Dx is of 6 bit for each R, G and B. This number is not limiting, and the picture signal Dx may be of 7 bit or more and of 5 bit and less.

If a digital picture signal that will be inputted into the data line drive circuit 1 is inputted for each 1 display element (3 pixels, 18 bit), when the number of pixels is QVGA (240 RGB.times.320), the clock frequency of the data line drive circuit 1 is (frame frequency).times.(number of pixels)=60 Hz.times.320.times.240=about 4.6 MHz. Even if in VGA whose pixel number (480 RGB.times.640) is 4 times of QVGA, if the picture signal is imputed into the data line drive circuit 1 is for every two display elements (36 bit), then the sufficient clock frequency will be 9.2 MHz.

The horizontal start signal STH is inputted into the shift register circuits 11, 21, and sampling signals synchronized with the clock signal CLK are successively generated in the shift register circuits 11, 21. The shift register circuit is composed of a plurality of flip-flop circuits. The picture signals Dx successively inputted synchronously with the clock signal CLK are latched in the data register circuits 12, 22 in accordance with the sampling signals. The picture signals Dx latched in the data register circuits 12, 22 are outputted in parallel into the data latch circuits 13, 23 in response to the input of the latch signal STB and latched in the data latch circuits 13, 23. The data latch circuits 13, 23 are connected to the D/A conversion circuits 14, 24 and supply positive polarity signals and negative polarity signals to each data line via the switching circuit 33 that selects alternately a positive polarity signal and a negative polarity signal in accordance with the polarity signal POL.

The data line drive circuit 1 in accordance with the present invention simultaneously outputs analog picture signals of different polarity into adjacent lines. The data line drive circuit 1 comprises a positive polarity drive circuit 10 for supplying an analog picture signal of positive polarity and a negative polarity drive circuit 20 for supplying an analog picture signal of negative polarity, and the positive polarity or negative polarity signal is selected and outputted into the data line by the switching circuit 33. Here, the positive polarity and negative polarity indicate a positive or negative side of the pixel voltage in the case where the voltage (com voltage) of the liquid crystal common electrode of the liquid crystal is taken as a reference voltage.

The present invention is particularly relates to a driver circuit providing analog signals to data lines. The operation voltage of the positive polarity drive circuit 10 is from VPL to VPH and the operation voltage of the negative polarity drive circuit 20 is from VNL to VLH. The reference voltage of the dive circuit driving data lines is the system GND (0V) and the com voltage is also the system GND. When VPL and VNH are the same as GND, VPL and VNH may be short circuited to GND. If the following relationships are valid: VPH>VPL, VPH>VNH, VNH>VNL, VPL>VNL, then the VNH and VPL may be different voltages. Hereinafter, for simplifying the explanation, it is assumed in the explanation of this embodiment 1 that VPL=VNH=GND, VPH=5V, VNL=−5V. Furthermore, if the operation is conducted at a liquid crystal threshold voltage of about 3V, then the VPH may be 3V and VNL may be −3V. Or if the feed-through error due to a parasitic capacitor of a TFT is taken into account, VPH may be 6V and VNL may be −4V, or VPH may be 4V and VNL may be −6V.

The positive polarity drive circuit 10 comprises at least a positive polarity D/A conversion circuit 14 and a positive polarity gradation voltage generation circuit 15. In the present embodiment, the positive polarity drive circuit 10 further comprises a positive polarity shift register circuit 11, a positive polarity register circuit 12 that is a latch circuit, and a positive polarity data latch circuit 13. The operation voltage of each circuit is GND to VPH. The negative polarity drive circuit 20 comprises at least a negative polarity D/A conversion circuit 24 and a negative polarity gradation voltage generation circuit 25. It also further comprises a negative polarity shift register circuit 21 that is a latch circuit, a negative polarity register circuit 22, and a negative polarity data latch circuit 23. The operation voltage of each circuit is VNL to GND.

The signal processing circuit 31 operates at VSS to VDD (2.5V). Therefore, a level shift circuit 32 is provided between the signal processing circuit 31 and the positive polarity drive circuit 10 and negative polarity drive circuit 20. If the low-level voltage VSS of the signal processing circuit 31 may be short circuited to GND, or the VSS may be a voltage different from GND. Hereinafter, in the embodiment 1, it is assumed that VSS is the same as GND for simplifying the explanation.

The level shift circuit 32 comprises the below-described positive polarity level shift circuit 321 and negative polarity level shift circuit 322 correspondingly to the signal generated in the signal processing circuit 31 and also a high-voltage level shift circuit 323. The signals to be inputted into the positive polarity drive circuit 10 and negative polarity drive circuit 20 are inputted after being level shifted to respective operation voltages with the positive polarity level shift circuit 321 and negative polarity level shift circuit 322. For example, as for the CK3 signal generated from the clock signal CLK, the CK3_P signal with a level shifted to the positive polarity side is inputted into the positive polarity drive circuit 10 and the CK3_N signal with a level shifted to the negative polarity side is inputted into the negative polarity drive circuit 20. As for the other signals such as a start signal STH, similarly, the signal_P and signal_N are inputted into the positive polarity drive circuit 10 and negative polarity drive circuit 20, respectively. The signal controlling the switching circuit 33 is (VPH-VNL). Therefore, the signal is inputted via the high-voltage level shift circuit 323. Here, the voltage of the signal controlling the switching circuit 33 may be a voltage equal to or higher than the VPH and may be a voltage equal to or lower than the VNL.

Figure 11:
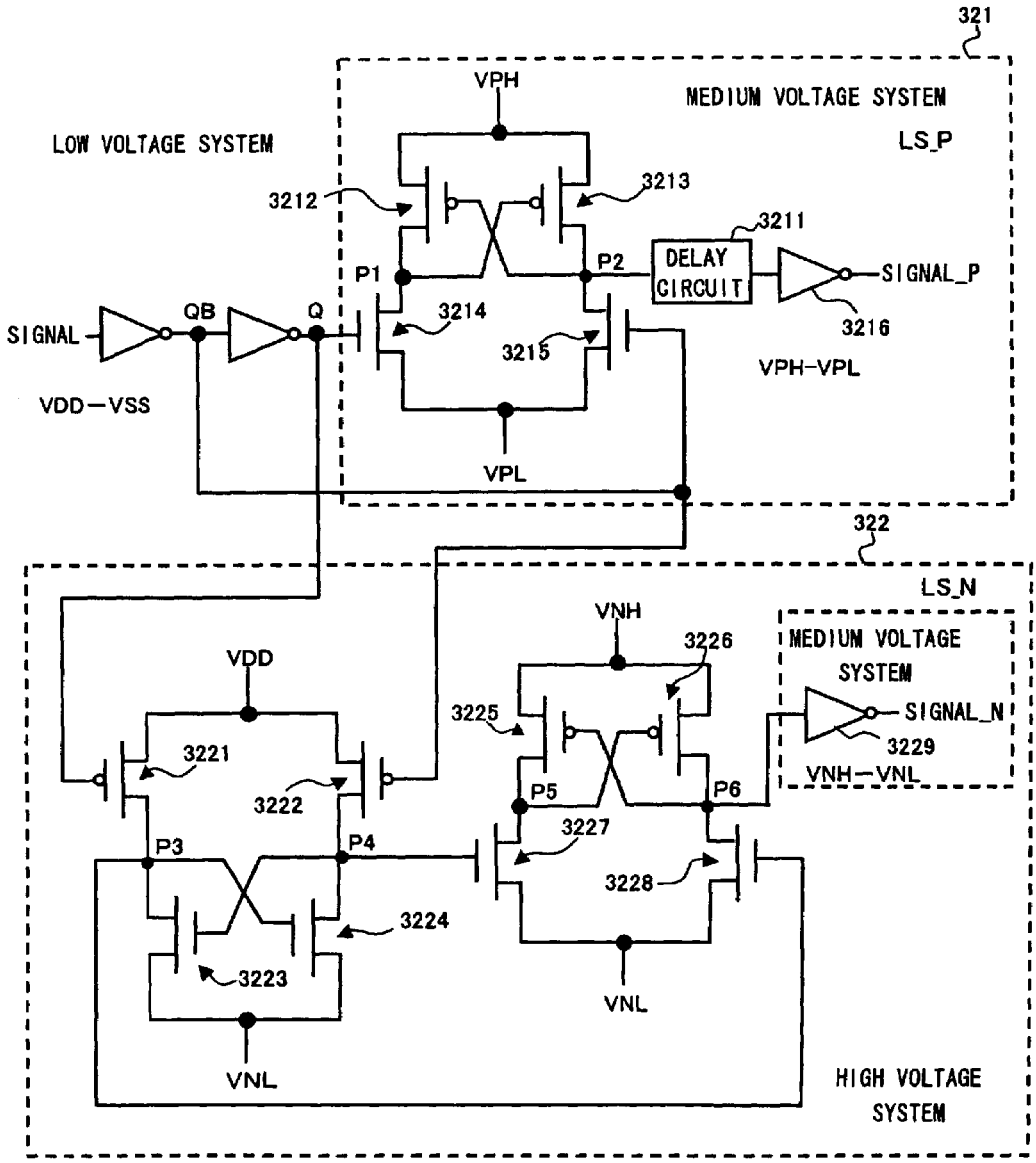
FIG. 11 is a detailed drawing of the positive polarity level shift circuit 321 and negative polarity level shift circuit 322 of the first embodiment of the present invention.
Figure 12:
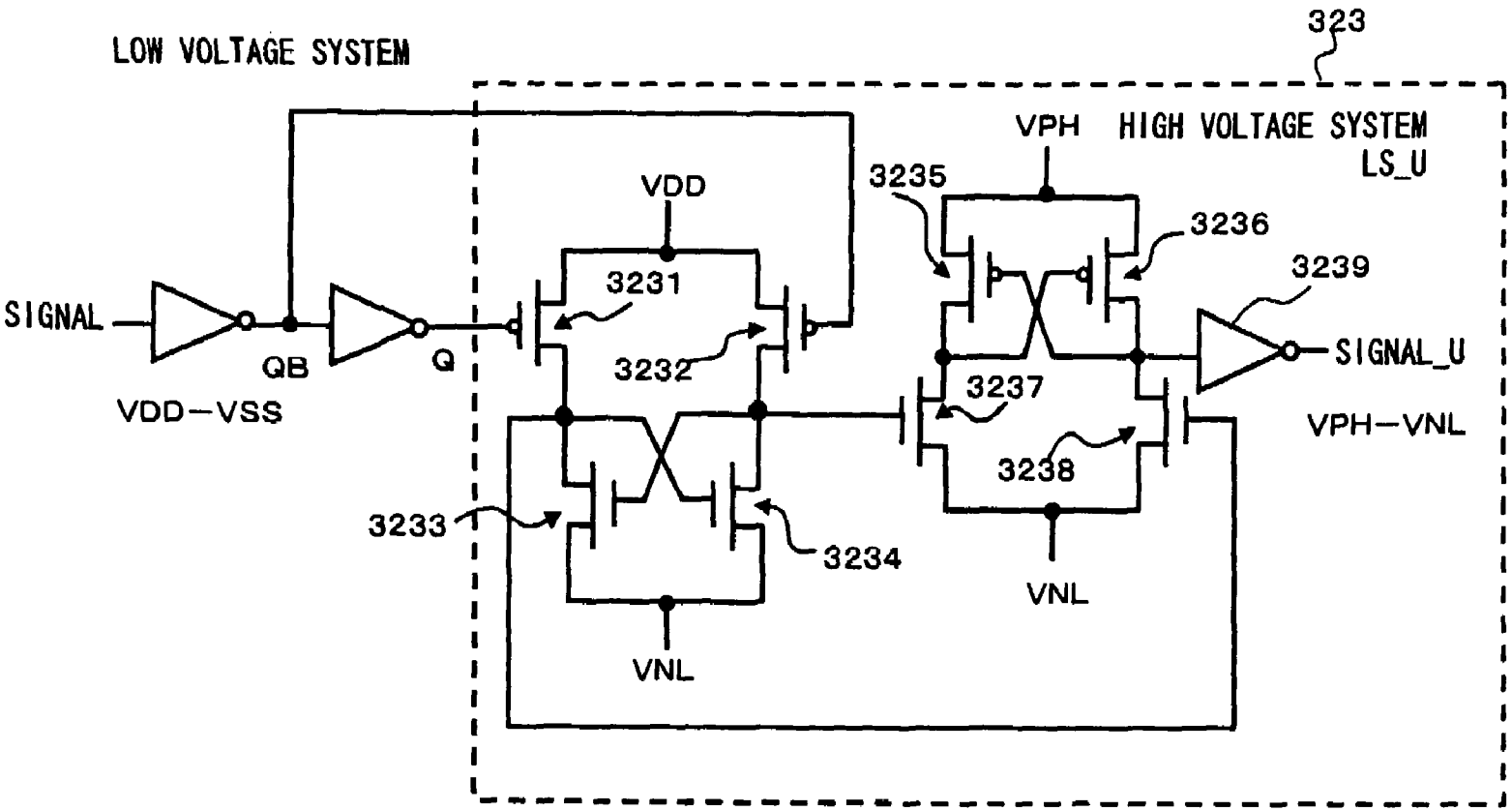
FIG. 12 is a detailed drawing of the high-voltage level shift circuit 322 of the first embodiment of the present invention.

The level shift circuit 32 will be described below in greater detail. The circuit shown in FIG. 11 and FIG. 12 is the level shift circuit 32 used in the present embodiment. The usual transistor notion is used in the circuit shown in FIGS. 11 and 12. Thus, the transistor with a circle attached to the gate is a P channel transistor, and that without a circle is a N channel transistor. The same notation is used in the below-described drawings. The positive polarity level shift circuit 321 shown in FIG. 11 converts the signals with a (GND-VDD) level into a positive polarity signal (GND-VPH). The negative polarity level shift circuit 322 converts the signal with a (GND-VDD) level into a negative polarity signal (VNL-GND). The positive polarity level shift circuit 321 is identical to a usually used level shift circuit, except that it has a delay circuit 3211. The positive polarity level shift circuit 321 converting the input voltage comprises a serial circuit of the P channel transistor 3212 and N channel transistor 3214 and a serial circuit of a P channel transistor 3213 and N channel transistor 3215, those circuits being connected in parallel between the VPH-GND. The input from the outside is inputted into the gate of the N channel transistor 3214 or N channel transistor 3215 on the low-voltage side, and a signal is outputted from the intermediate node (between the P channel transistor 3213 and N channel transistor 3215) P2 of the P channel transistor 3213 and N channel transistor 3215 in one serial circuit. The gate of the P channel transistor 3212 or P channel transistor 3213 is connected to the intermediate node P1 or P2 of the other serial circuit.

The operation of the positive polarity level shift circuit 321 will be described below. For the sake of simplicity, the output of a node P2 with respect to the input of a node Q or node QB will be explained. When the "H" level, that is, a VDD voltage is inputted into the node Q, the N channel transistor 3214 becomes active, and the node P1 assumes GND, that is, a "L" level. Therefore, the P channel transistor 3213 becomes active and the node P2 assumes VPH. Conversely, when an "L" level, that is, GND, is inputted into the node Q, because the node QB is at a "HH" level at this time, the N channel transistor 3215 become active. Therefore, the node P2 assumes GND. The signal that was thus outputted according to the input signal is outputted to the outside by an inverter 3216 via a delay circuit 3211.

The negative polarity level shift circuit 322 is a level shift circuit of a two-stage structure, where the level shifter of the first stage provides for VNL-VDD shift, and the level shifter of the second stage provides for VNL-GND shift. The first stage comprises a serial circuit of the P channel transistor 3221 and N channel transistor 3223 and a serial circuit of the P channel transistor 3222 and N channel transistor 3224, which are connected between the VDD and VNL. The input from the outside is inputted into the gate of the P channel transistor 3221 or P channel transistor 3222 on the high-voltage side, and a signal is outputted from the intermediate node P4 of the P channel transistor 3222 and N channel transistor 3224 in one serial circuit. The gate of the N channel transistor 3223 or N channel transistor 3224 is connected to the intermediate node P3 or P4 of the other serial circuit. The signals of different polarity from the outside are inputted from the nodes QB, Q into the gate of each P channel transistor connected to the high-voltage side.

In the second stage, the outputs from the first stage are inputted into gates of the N channel transistor 3227 or N channel transistor 3228 connected to the low-voltage side. The output of the second stage is outputted to the outside via the inverter 3229. The circuit configuration of the second stage is identical to that of the level shifter 3211 of the positive polarity level shift circuit, though the power source voltage is different. Thus, the second stage comprises a serial circuit of the P channel transistor 3225 and N channel transistor 3227 and a serial circuit of the P channel transistor 3226 and N channel transistor 3228, those circuits being connected between GND and VNL.

The operation of the negative polarity level shift circuit 322 will be described below. First, the output of the node P3 and node P4 corresponding to the node Q or node QB will be explained. When a "H" level, that is, VDD is inputted into the node Q, because the node QB is an "L" level, that is, at GND, the P channel transistor 3222 becomes active. Therefore, the node P4 assumes VDD, that is, "H" level. As a result, the N channel transistor 3223 becomes active, and the node P3 assumes VNL, that is, "L" level. Conversely, when "L" level, that is, GND is inputted to the node Q, the P channel transistor 3221 becomes active and the node P3 assumes VDD, that is, "H" level. Therefore, the N channel transistor 3224 becomes active and the node P4 assumes VNL, that is, "L" level.

The output of the node P6 relating to node P4 will be explained below. When the node P4 is at "H" level, that is, VDD, the N channel transistor 3227 becomes active and the node P5 assumes VNL, that is, "L" level. As a result, the P channel transistor 3226 becomes active and the node P6 assumes GND. Conversely, when the node P4 is at "L" level, that is, VNL, the node P3 assumes "H" level. As a result, the N channel transistor 3228 becomes active. Therefore, node P6 assumes VNL.

The negative polarity level shift circuit 322, which has a two-stage configuration, has a long delay time. Therefore, as described above, the delay circuit 3221 may be provided so as to obtain a delay time in the positive polarity level shift circuit 321 equal to that in the negative polarity level shift circuit. Although, the level shift can be also conducted by using a converter, it is not always suitable for liquid crystal displays and other portable electronic devices as a stationary current flow in the converter and power consumption therein is high.

The high-voltage level shift circuit 323 is shown in greater detail in FIG. 12. The circuit configuration of this circuit is substantially identical to that of the negative polarity level shift circuit 322 and is composed of two stages. Specifically, the first stage comprises a serial circuit of the P channel transistor 3231 and N channel transistor 3233 and a serial circuit of the P channel transistor 3232 and N channel transistor 3234, those circuits being connected between the VDD and VNL. The second stage comprises a serial circuit of the P channel transistor 3235 and N channel transistor 3237 and a serial circuit of the P channel transistor 3236 and N channel transistor 3238, those circuits being connected between VPH and VNL. The high-voltage level shift circuit 323 shifts the signal with a (GND-VDD) level to the (VNL-VPH) level. In the first stage, the signals with a (GND-VDD) level is shifted to the (VNL-VDD) level, and in the second stage it is shifted to the (VNL-VPH) level. The operation principle is identical to that of the above-described negative polarity level shift circuit 322 and the explanation thereof is, therefore, omitted. The output of the second stage is outputted to the outside via an inverter 3239. As described hereinabove, the switching circuit 33 is at a voltage equal to or higher than the VPH and a voltage equal to and lower than the VNL. Therefore, in this case, the operation voltage of the high-voltage level shift circuit 323 is a voltage equal to or higher than the VPH and a voltage equal to or higher than the VNL.

Figures 13, 14:
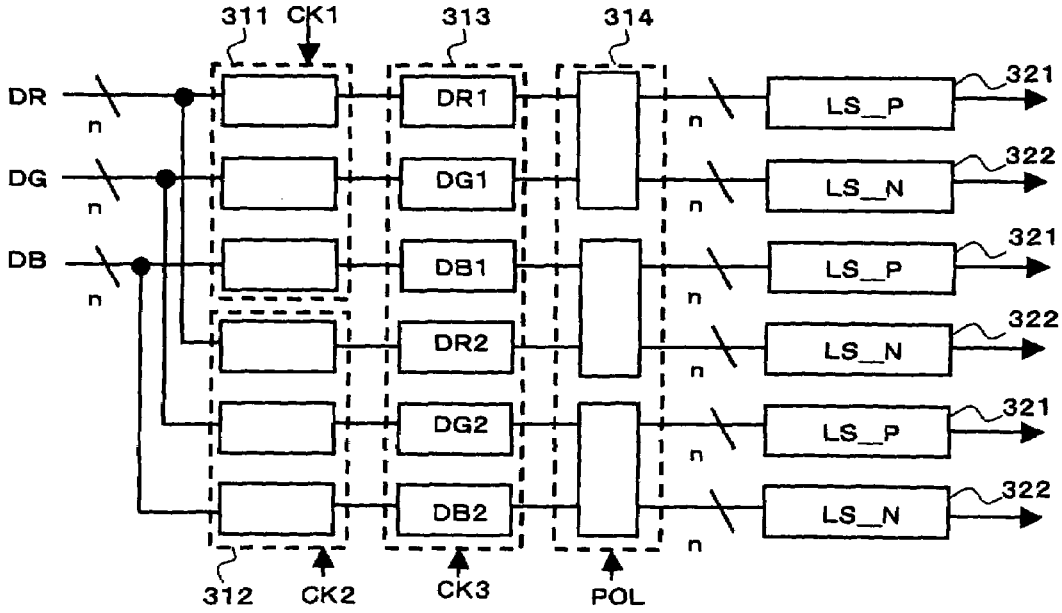
FIG. 13 illustrates schematically the polarity of pixels in the dot inversion drive of the first embodiment of the present invention.
FIG. 14 shows a circuit for distributing the signals of the signal processing circuit 31 of the first embodiment of the present invention.

When color display is conducted, one display element is composed of three pixels (dots) of RGB. Therefore, the three dots of RGB constitute a unit of display color. In the dot reverse drive system, as shown in FIG. 13, (+, −, +) is applied to the first display element (R1, G1, B1) of the X1 line, and (−, +, −) is applied to the second display element (R2, G2, B2). In other words, because the polarity of adjacent dots is different, in the two adjacent terminal Y(2*i*−1), Y(2*i*) (i is natural number), plus and minus or minus and plus are supplied at the same time. Here, the circuit configuration of the signal processing circuit 31 is simplified if control is conducted for 6 dots unit, which is a common multiple of 2 and 3, that is for every 2 display elements, rather than for 3 dots unit of RGB (1 display element), that is, 2 dots unit of plus and minus. In addition to 6 dots unit, it is preferred that the control be conducted in the number of bits which is a multiple of 6, such as 12 dots units or 18 dots units.

FIG. 14 shows a circuit in which the picture signal Dx (DR, DG, DB) is allocated to the positive polarity drive circuit 10 or negative polarity drive circuit 20 in the signal processing circuit 31. The first display element picture signal (DR1, DG1, DB1) and the second display element picture signal (DR2, DG2, DB2) are respectively latched in the latch circuit 311 and latch circuit 312 in accordance with the CK1 signal and CK2 signal, and the first display element picture signal (DR1, DG1, DB1) and the second display element picture signal (DR2, DG2, DB2) are latched simultaneously with the latch circuit 313 in accordance with the CK3 signal. The picture signal latched in the latch circuit 313 is selectively inputted by the picture signal switching circuit 314 into one of the positive polarity drive circuit 10 and negative polarity drive circuit 20. The selection of the output of the picture signal switching circuit 314 is conducted according to the H, L of the polarity signal POL.

FIG. 14 relates to the case wherein the picture signal Dx, which is to be inputted into the data line drive circuit 1, is inputted for each 1 display element, and the picture signal is latched for 6 dots in a latch circuit 313 by using the latch circuits 311, 312 and CK1, CK2 signal generated from the clock signal CLK, in order to conduct processing in 6 bit units. However, if the picture signal which is to be inputted into the data line drive circuit 1 is originally for 2 display elements (36 bit), then the latch circuits 311 and 312 are unnecessary and the picture signal Dx may be latched in the latch circuit 313 synchronously with the clock signal CLK. Therefore, generation of clock signals CK1, CK2, CK3 may be omitted. As a result, the circuit scale can be reduced. Further, the CLK_P signal and CLK_N signal may be generated from the clock signal CLK and inputted into the positive polarity drive circuit 10 and negative polarity drive circuit 20.

Figure 15A:
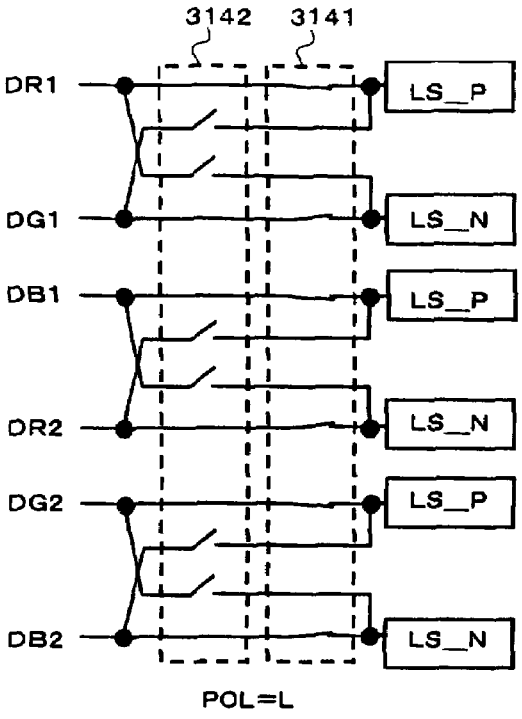
FIGS. 15A, 15B show detailed diagrams of the picture signal switching circuit 314 of the first embodiment of the present invention.
Figure 15B:
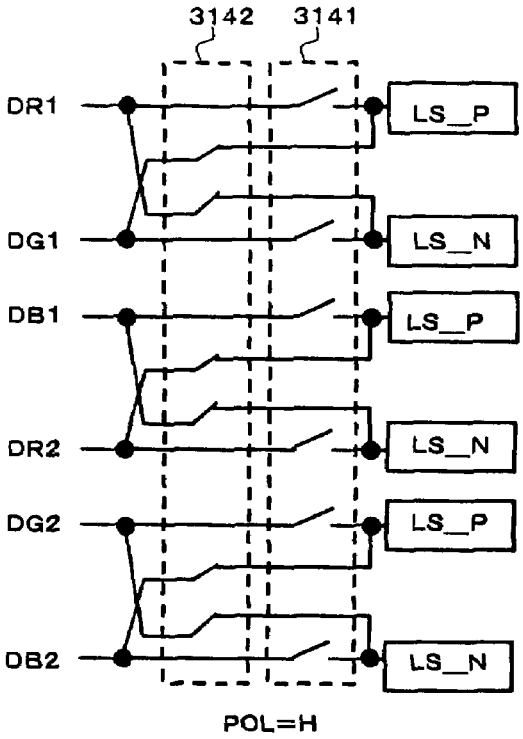

FIGS. 15A, 15B show detailed drawings of the picture signal switching circuit 314 and a switch state corresponding to the polarity signal POL. FIG. 15A shows the state where the polarity signal POL=L, and FIG. 15B shows the state where the polarity signal POL=H. The picture signal switching circuit 314 comprises a switch 3141 and a switch 3142. The picture signal switching circuit 314 switches ON and OFF the switches 3141, 3142 correspondingly to the H, L of the polarity signal POL by taking the picture signals DR1 and DG1, DB1 and DR2, and DG2 and DB2 as respective pairs, thereby switching the input to the positive polarity level shift circuit 321 or negative polarity level shift circuit 322. Referring to FIGS. 15A, 15B, when the polarity signal POL=L (FIG. 15A), the switch 3141 is ON and the switch 3142 is OFF (equivalent to X1 line of FIG. 13) When the polarity signal POL=H, as shown in FIG. 15B, the switch 3141 is OFF and the switch 3142 is ON (equivalent to X2 line of FIG. 13).

Figure 16A:
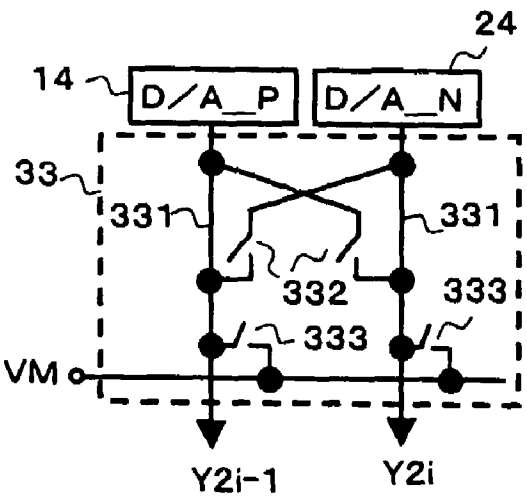
FIGS. 16A-16C show detailed diagrams of the switching circuit 33 of the first embodiment of the present invention.
Figure 16B:
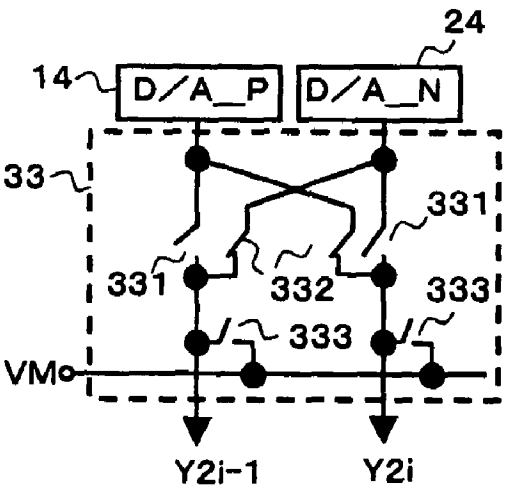
Figure 16C:
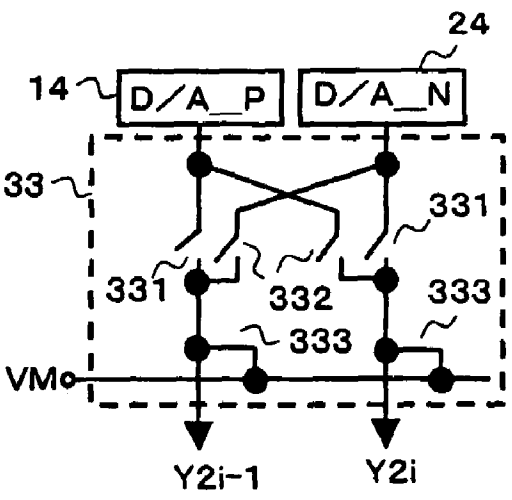

FIG. 16 shows in detail the switching circuit 33 for switching the outputs from the DA conversion circuits 14, 24 and outputting them to the data line. The switching circuit 33 comprises a switch 331, a switch 332, and a pre-charge switch 333. The switching circuit 33 is fabricated from the below-described high-voltage elements. The positive polarity drive circuit 10 and negative polarity drive circuit 20 are fabricated from the below-described medium-voltage elements. The medium voltage is the voltage equal to the threshold voltage of the liquid crystal, and the high voltage is the voltage more than twice the threshold voltage of the liquid crystal.

Figure 17:
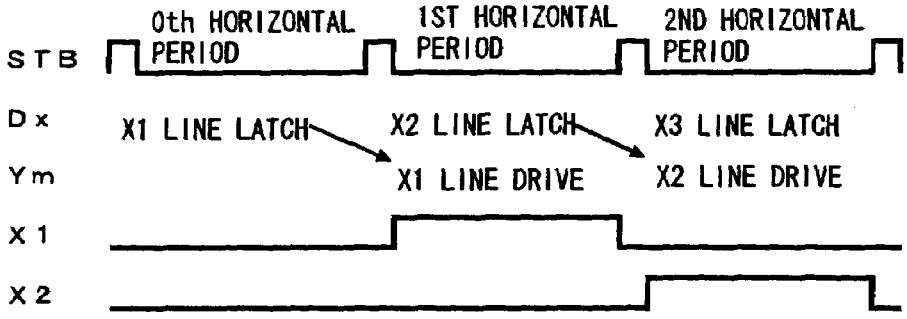
FIG. 17 is a timing diagram of picture signals and drive signals of the first embodiment of the present invention.

FIG. 17 is a timing chart showing the relationship between the timing of latching the picture signal with the data register circuits 12, 22 and the timing of driving the data line. As shown in FIG. 17, the timing of latching the picture signal with the data register circuits 12, 22 and the timing of driving the data line are generally staggered by one horizontal period. In other words, the picture signal corresponding to the scanning line Xk is latched in the data register circuits 12, 22 in the (k−1)-th horizontal period, the picture signal latched in the (k−1)-th horizontal period is latched by the data latch circuits 13, 23 in the k—the horizontal period, and the data line is driven by the signal corresponding to this picture signal.

Figure 18:
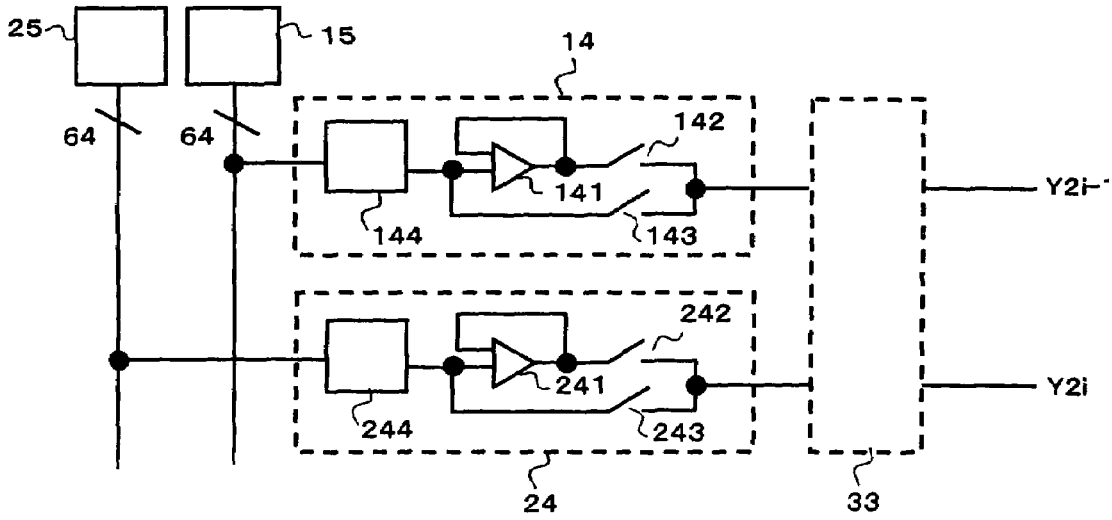
FIG. 18 is a timing diagram of the D/A conversion circuit of the first embodiment of the present invention.
Figure 19:
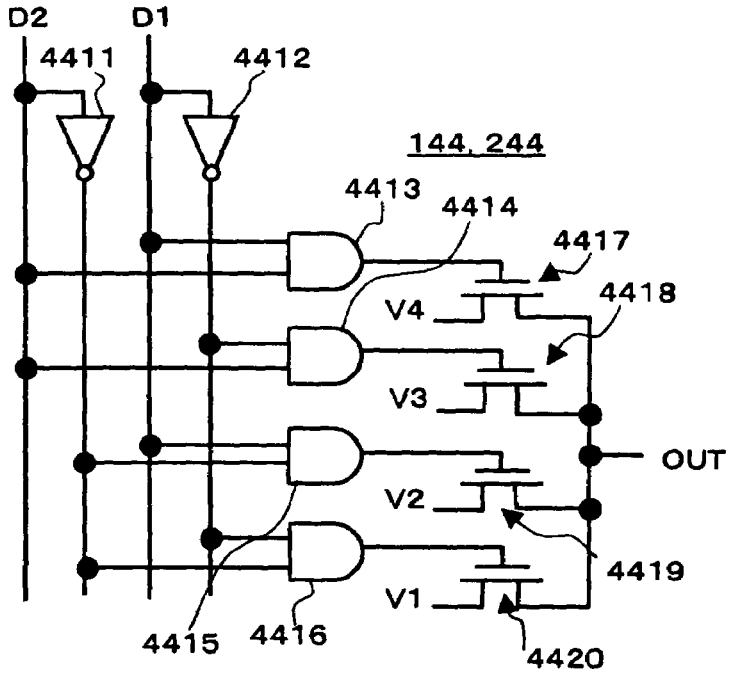
FIG. 19 shows a decoder circuit of the first embodiment of the present invention.
Figure 20:
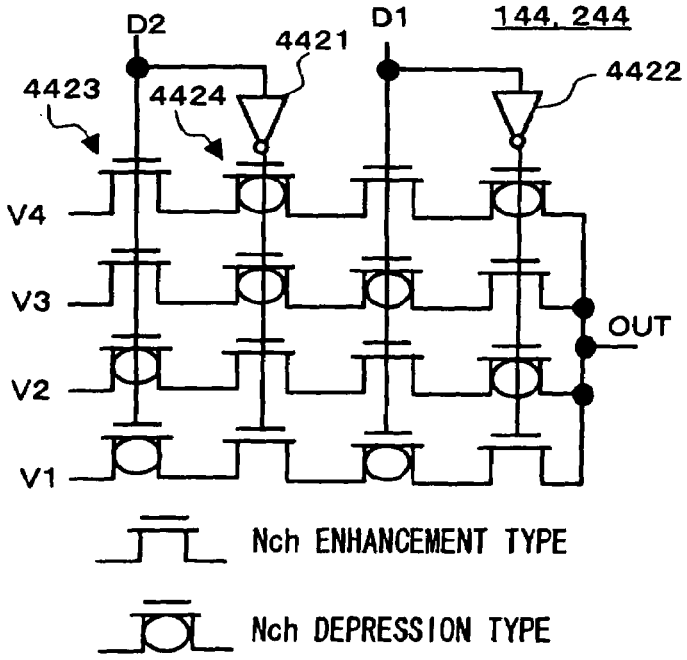
FIG. 20 shows a decoder circuit of the first embodiment of the present invention.

FIG. 18 is a detailed drawing of the D/A conversion circuits 14, 24. The D/A conversion circuits 14, 24 can be constituted of circuits comprising decoder circuits 144, 244, amplifiers 141, 241, and switches 142, 143, 242, 243. The decoder circuits 144, 244 can be configured, for example, as shown in FIG. 19. In FIG. 19, they are configured of a logical circuit and a plurality of switches and comprise input terminals for inputting the picture signal Dx, an inverter 4411, an inverter 4412, logical circuits 4413, 4414, 4415, and 4416, N channel transistors 4417, 4418, 4419, 4420, and an output terminal. They can be also configured as shown in FIG. 20. In the configuration shown in FIG. 20, they have an input terminal for inputting the picture signal Dx, an inverter 4421, an inverter 4422, an N channel enhancement-type 4423, an N channel depression-type 4424, and an output terminal. A plurality of switches for selecting the gradation voltage are configured of transfer switches having a P channel transistor and an N channel transistor connected in parallel. To facilitate the explanation, only the N channel transistor is shown. The positive polarity gradation voltage generation circuit 15 and a negative polarity gradation voltage generation circuit 25 are composed of a resistor string circuits in which a plurality of resistors are connected in series, the resistances thereof are so set as to match the gamma characteristic, and the desired gradation voltage (Vn) is obtained from each connection point. Each gradation voltage is connected to the D/A conversion circuits 14, 24.

Figure 21:
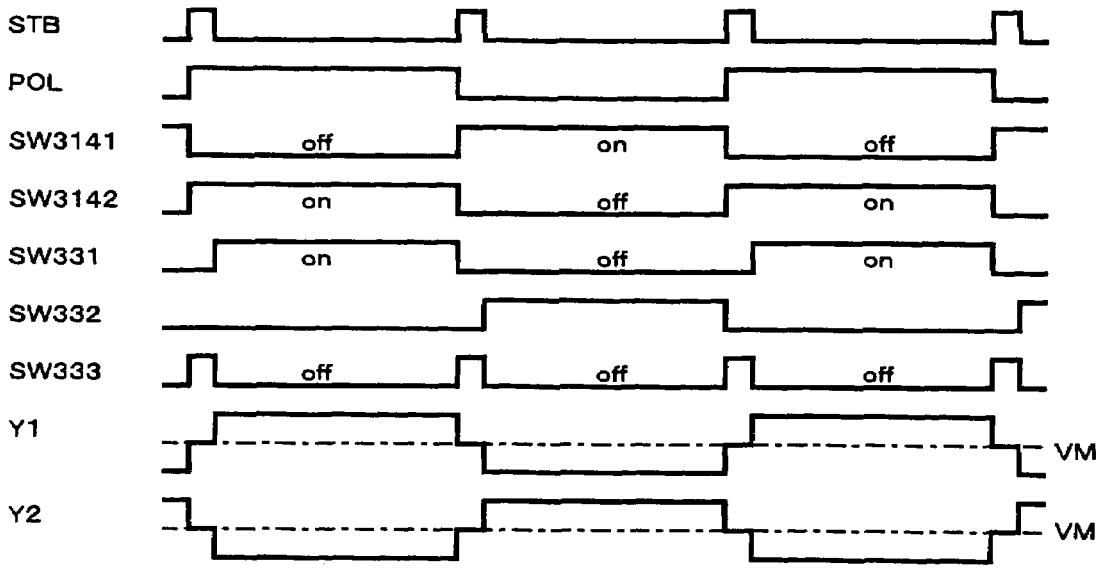
FIG. 21 is a timing chart used of the first embodiment of the present invention.

The operation of each switch will be explained below by using the timing chart shown in FIG. 21 and FIGS. 15 and 16. To elucidate the explanation, the case will be considered where there are six data lines and 2 scanning lines, as shown in FIG. 13. It is also assumed that a terminal Y1 is connected to a data line R1, a terminal Y2 is connected to a data line G1, a terminal Y3 is connected to a data line B1, a terminal Y4 is connected to a data line R2, a terminal Y5 is connected to a data line G2, and a terminal Y6 is connected to a data line B2, and the picture signals corresponding to each data line (R1, G1, B1, R2, G2, B2) are represented by (DR1, DG1, DB1, DR2, DG2, DB2). Further, an example will be explained in which a dot inversion drive is conducted such that the polarity of each element in the first scanning line X1 becomes (+, −, +, −, +, −) and the polarity of each element in the second scanning line X2 becomes (−, +, −, +, −, +) as shown in FIG. 13.

First, data lines R1 and G1 will be explained as an example in order to simplify the explanation. When a polarity signal POL is "L" in the (k−1)-th horizontal period, the picture signal switching circuit 314 is in the switch state shown in FIG. 15A, the switch 3141 is switched ON, the switch 3142 is switched OFF, and the picture signal DR1 is inputted into the positive polarity drive circuit 10 via the positive polarity level shift circuit 321 and latched in the positive polarity data register circuit 12. The picture signal DG1 is inputted into the negative polarity drive circuit 20 via the negative polarity level shift circuit 322 and latched in the negative polarity data register circuit 22. If a latch signal STB is inputted in the k-th horizontal period, the picture signals (DR1, DG1) latched in the data register circuits 12, 22 are latched in the data latch circuits 13, 23. At this time, the polarity signal POL is switched from "L" to "H". The positive polarity signal corresponding to the picture signal DR1 is inputted into the positive polarity D/A conversion circuit 14. Further, at the same time, the negative polarity signal corresponding to the picture signal DG1 is inputted in the negative polarity D/A conversion circuit 24. When the polarity signal POL is "H", in the switching circuit 33, the switch 331 is switched ON and the switches 332 and 333 are switched OFF, as shown in FIG. 16A, the positive polarity signal corresponding to the picture signal DR1 is supplied to the data line R1, and the positive polarity signal corresponding to the picture signal DG1 is supplied to the data line G1.

When the polarity signal POL is "H" in the (k−1)-th horizontal period, the picture signal switching circuit 314 is in a switch state shown in FIG. 15B, the switch 3142 is switched ON, the switch 3141 is switched OFF, and the picture signal DR1 is inputted into the negative polarity drive circuit 20 via the negative polarity level shift circuit 322 and latched in the negative polarity data register circuit 22. The picture signal DG1 is inputted into the positive polarity drive circuit 10 via the positive polarity level shift circuit 321 and latched in the data register circuit 12. If the latch signal STB is inputted in the k-th horizontal period, the picture signals (DR1, DG1) latched in the data register circuits 22, 12 are latched in the data latch circuits 13, 23. At this time, the polarity signal POL is switched from "H" to "L". A negative polarity signal corresponding to the picture signal DR1 is selected with the negative polarity D/A conversion circuit 24 and at the same time, a positive polarity signal corresponding to the picture signal DG1 is selected with the positive polarity D/A conversion circuit 14. When the POL is "L", in the switching circuit 33, the switch 332 is switched ON and the switches 331 and 333 are switched OFF, as shown in FIG. 16B, the negative polarity signal corresponding to the picture signal DR1 is supplied to the data line R1, and the positive polarity signal corresponding to the picture signal DG1 is supplied to the data line G1.

Though the explanation above was with respect to the data lines R1 and G1, the positive polarity or negative polarity signal corresponding to the picture signals DB1 and DR2 are outputted to the data line B1 and data line R2, and the positive polarity or negative polarity signal corresponding to the picture signals DG2 and DB2 is outputted to the data line G2 and data line B2. Each signal processing operation is identical to the operation explained with respect to the above-described R1 and G1.

In the period in which the latch signal STB is "H", the pre-charge switch 333 is switched ON, the switches 331 and 332 are switched OFF and the output terminals are short circuited to the VM. The VM is a medium voltage of VPH and VNL, however, if the medium voltage of VPH and VNL is GND, then short circuiting may be conducted to GND. The terminals are thus short circuited and the supply of voltage exceeding the breakdown voltage to the D/A conversion circuits is prevented.

More specifically, if we assume that a positive polarity signal was supplied to the data line in the (k−1)-th horizontal period, then a negative polarity signal is supplied by the negative polarity D/A conversion circuit 24 in the k-th horizontal period, however, the data line holds the voltage of positive polarity. Therefore, the voltage exceeding the breakdown voltage is instantaneously supplied to the negative polarity D/A conversion circuit 24. As a result, in the most unfavorable case, the negative polarity D/A conversion circuit composed of medium voltage elements will be destroyed. Accordingly, the data lines are pre-charged to VM and then the data lines are driven by the negative polarity D/A conversion circuit 24 so as to prevent the application of voltage exceeding the voltage breakdown to the negative polarity D/A conversion circuit 24. The same is applied to the positive polarity D/A conversion circuit.

In the present embodiment, the picture signals that were level shifted to a positive polarity and negative polarity are inputted into the positive polarity drive circuit 10 and negative polarity drive circuit 20. Therefore, the level shift circuit corresponding to each data line, as in the conventional systems, is unnecessary. The number of level shift circuits for conducting level shift at the stage prior to inputting the signals generated in the signal processing circuit 31 into the positive polarity drive circuit 10 and negative polarity drive circuit 20 is equal to the number of control signals multiplied by two and becomes 40.times.2=80 at least for one clock signal CLK, one start signal STH, picture signals D.times.36, one latch signal STB, and one polarity signal POL. In the conventional data line drive circuits, when the number of pixels was QVGA (240RGB.times.320), the number of the level shift circuits was equal to the product of the number of data lines and the bit number, n, of the picture signals and, therefore, 240.times.3.times.6=432—0 circuits were required. By contrast, in accordance with the present invention, this number can be reduced to 80/4320=about 1/54.

Further, in the conventional switching circuit 64, the number of switching circuits was a product of the number of data lines and the bit number of picture signals. However, in accordance with the present invention, the number of switching circuits in the picture signal switching circuit 314 is equal to the bit number of picture signal. Therefore, the number of switching circuits is reduced to 1/(number of data lines). Furthermore, in accordance with the present invention, even if the number of pixels changes, the number of level shift circuits does not change. Therefore, the above-described effect increases with the increase in the number of pixels.

In accordance with the present invention, the elements such as transistors in the shift register circuit, data register circuit, and data latch units increase in size. Therefore, the element surface area of those circuit units increases. However, because the effect obtained due to elimination of the switching circuit A and level shift circuit with a large element surface area is much larger, the chip surface area can be reduced.

In the present embodiment, the con voltage was considered as a low-level voltage of the power source circuit or GND. As a result, a circuit for generating the com voltage is unnecessary. Therefore, the circuitry scale of the power source circuit 8 can be reduced. In the power source circuit 8, VDC1 voltage (2.5V) is generated based on supplied the VDC voltage, 2.times.VDC1 (VDD2) is generated with a voltage step-up circuit, and VPH is generated from VDD2. −2.times.VDC1 (VSS2) is obtained from the 2.times.VDC1 by inverting with a diode, a switch, and a capacitor. VNL is generated from VSS2. In the conventional system, a two-stage voltage increase was used for generating 5V from 2.5V and then generating 10V from 5V. However, in accordance with the present invention, because the com voltage is set to GND, one-stage voltage increase from 2.5V to 5V is conducted. Therefore, the power source efficiency is 80% and better than 64% of the conventional system. As a result, power consumption is reduced.

An example of fabricating the data line drive circuit 1 in accordance with the present invention with a semiconductor fabrication apparatus will be explained hereinbelow. In accordance with the present invention, an example of manufacturing by a diffusion process of a low-voltage element (2.5 V), medium-voltage element (5 V), and high-voltage element (10V) will be explained. The voltages in the parentheses hereinabove are merely example voltages, and other voltages may be employed as long as it is satisfied that low voltage<medium voltage<high voltage.

In the device elements such as transistors in semiconductor circuits, the element surface area is known to increase with the increase in voltage. The following relationship is valid between the minimum gate length Lmin, gate width Wmin, and gate oxide film thickness Tox: Lmin (2.5 V)<Lmin (5 V)<Lmin (10 V), Wmin (2.5 V)<Wmin (5 V)<Wmin (10 V), Tox (2.5 V)<Tox (5 V)<Tox (10 V). Therefore, the chip size can be reduced by employing a circuit configuration in which the employment of high-voltage elements is reduced to a minimum. In the present embodiment, the high-voltage elements are formed only in parts of the switching circuit 33 and level shift circuit 32 and the chip size can be reduced.

In the present embodiment, the signal processing circuit 31 was fabricated from low-voltage elements, the positive polarity drive circuit 10 and negative polarity drive circuit 20 were fabricated from medium-voltage elements, and parts of the switching circuit 33 and level shift circuit 32 were fabricated from high-voltage elements. When the threshold voltage of liquid crystals is as low as 3V, the signal processing circuit 31, positive polarity drive circuit, and negative polarity drive circuit may be fabricated from medium-voltage (3 V) elements and parts of the switching circuit 33 and level shift circuit 32 may be fabricated form high-voltage (6 V) elements.

Figure 22:
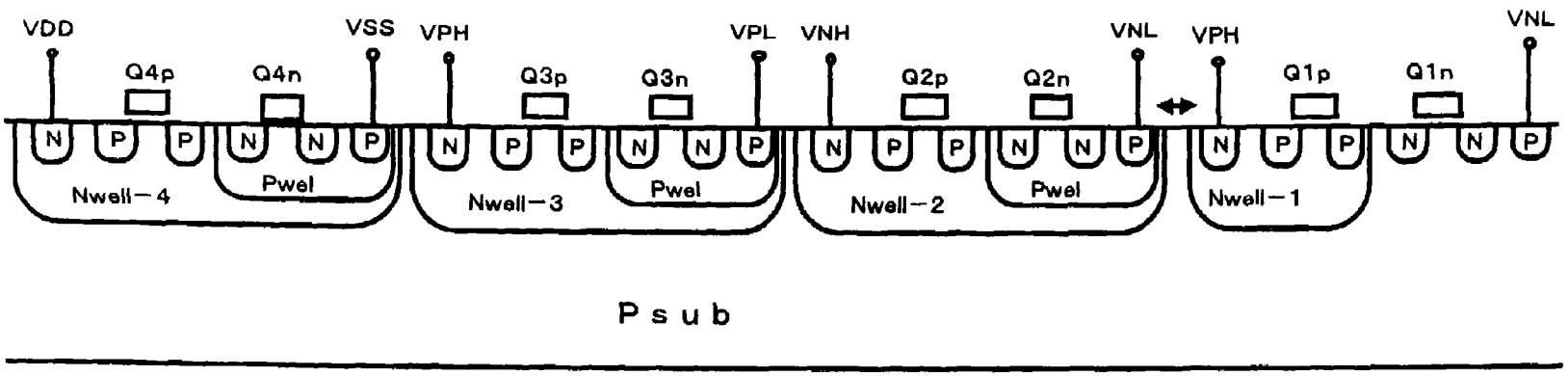
FIG. 22 is a cross-sectional vide of a semiconductor circuit device of the first embodiment of the present invention.
Figure 23:
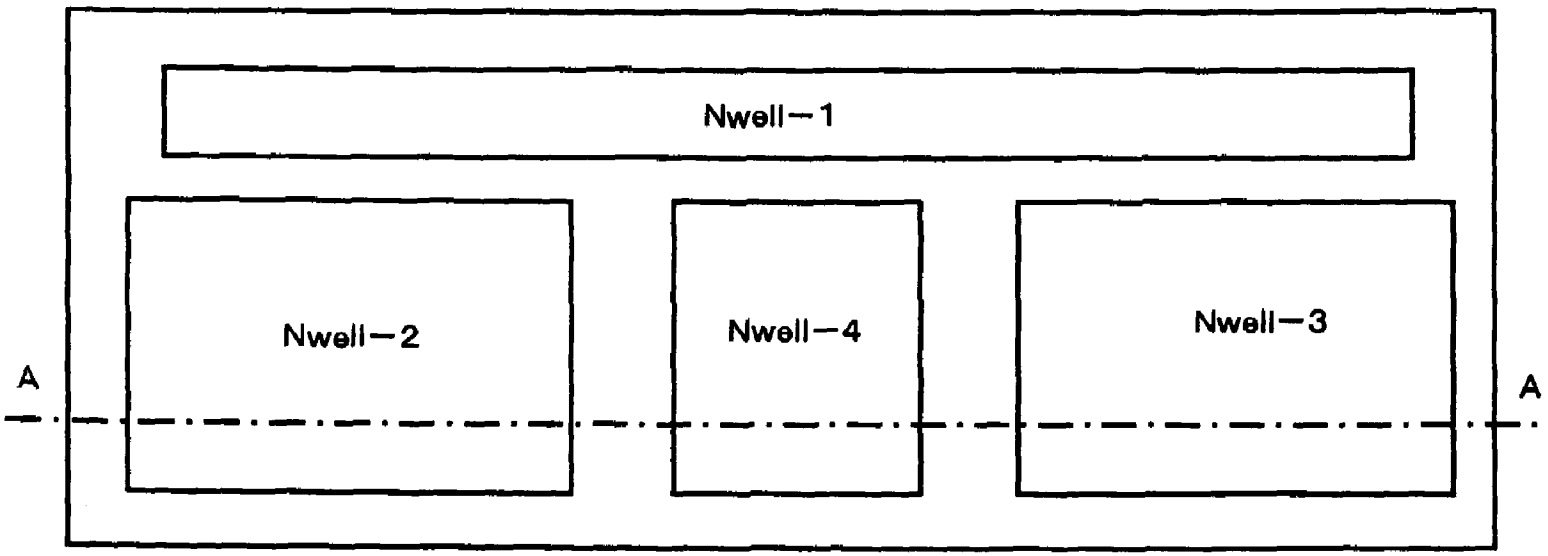
FIG. 23 is an area arrangement diagram of the first embodiment of the present invention.
Figure 24:
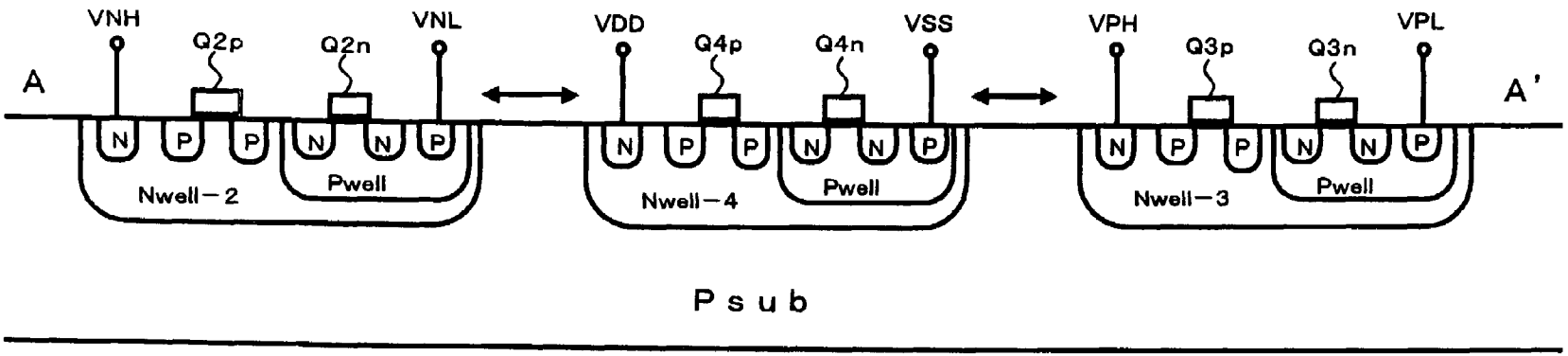
FIG. 24 is a cross-sectional view of a semiconductor circuit device of the first embodiment of the present invention.

FIG. 22 is a cross-sectional view illustrating the substrate in the semiconductor circuit device and the configuration of elements on the substrate. FIG. 23 is a schematic view of a layout of the data line drive circuit of the present embodiment. FIG. 24 is a cross-sectional view along 10 the A-A' line in FIG. 23. The N-type transistor fabricated at a high-voltage level is denoted by Q1*n*, the P-type transistor is denoted by Q1*p*, the N-type transistor on the N-well-2 fabricated at a medium-voltage level is denoted by Q2*n*, the P-type transistor is denoted by Q2*p*, the N-type transistor on the N-well-3 is denoted by Q3*n*, the P-type transistor is denoted by Q3*p*, the N-type transistor on the N-well-4 fabricated on the low-voltage level is denoted by Q4*n*, and the P-type transistor is denoted by Q4*p*.

The substrate (P-sub) voltage is at a minimum voltage VNL=−5V, the signal processing circuit 31 is fabricated on the N-well-4, the positive polarity drive circuit 10 is fabricated on the N-well-3, the negative polarity drive circuit 20 is fabricated on the N-well-2, and parts of the switching circuit 33 and level shift circuit 32 are fabricated on the P-sub and N-well-1. In the semiconductor circuit device, device elements other than transistors, for example, resistors, capacitors, and diodes are present, and voltage resistance of those elements is also ensured.

As shown in FIG. 25, when the operation is conducted at voltages (VDD=2.5V, VSS=GND, VPH=5V, VPL=GND, VNH=GND, VNL=−5V), the substrate (P-sub) is −5V, N-well-1 is VPH, N-well-2 is GND, N-well-3 is VPH, and Vwell-4 is VDD.

Figure 26A:
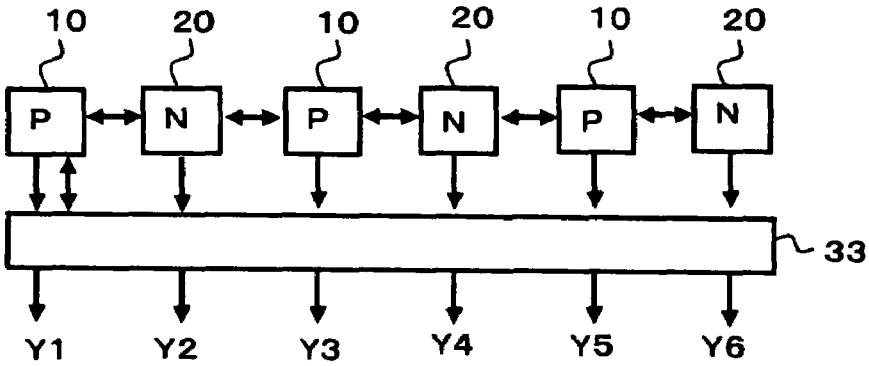
FIGS. 26A-26C show arrangement diagrams of the positive polarity drive circuit and negative polarity drive circuit of the first embodiment of the present invention.
Figure 26B:
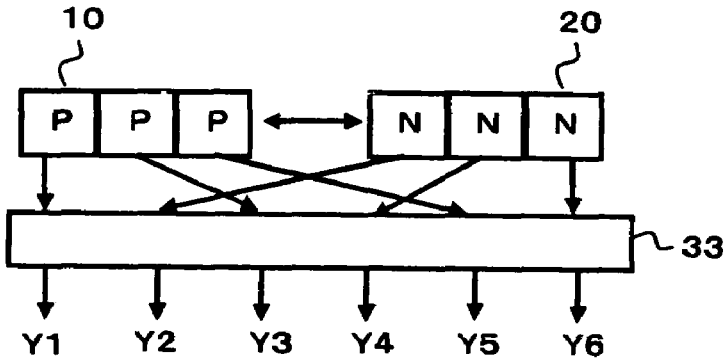
Figure 26C:
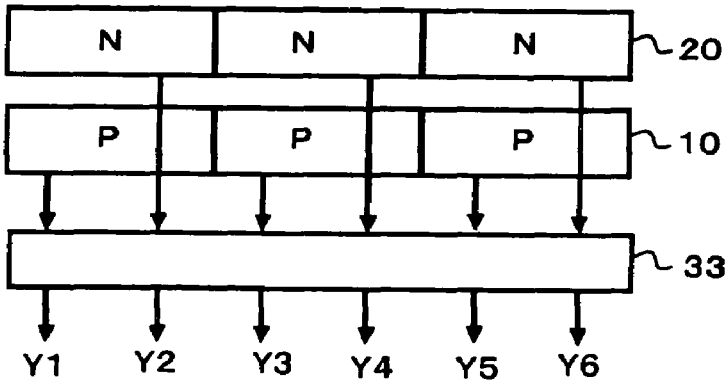

The spacing between N-well of different voltages has to be several tens of microns and, as shown in FIG. 26A, the chip size can be reduced by arranging the positive polarity drive circuit 10 and negative polarity drive circuit 20 in different continuous regions, rather than disposing the positive polarity drive circuit 10 and negative polarity drive circuit 20 alternately, as shown in FIG. 26A. In other words, as shown in FIG. 26B or FIG. 26C, the positive polarity drive circuit 10 is formed in the first continuous region, the negative polarity drive circuit 20 is formed in the second continuous region, which is different from the first continuous region, and N-well of the same voltage are disposed together. As a result, the chip size can be reduced.

In the arrangement shown in FIG. 23, which corresponds to that in FIG. 26B, the positive polarity drive circuit 10 (N-well-3) and negative polarity drive circuit 20 (N-well-2) are disposed on the right and left sides of a line parallel to the Y axis.

Figure 27:
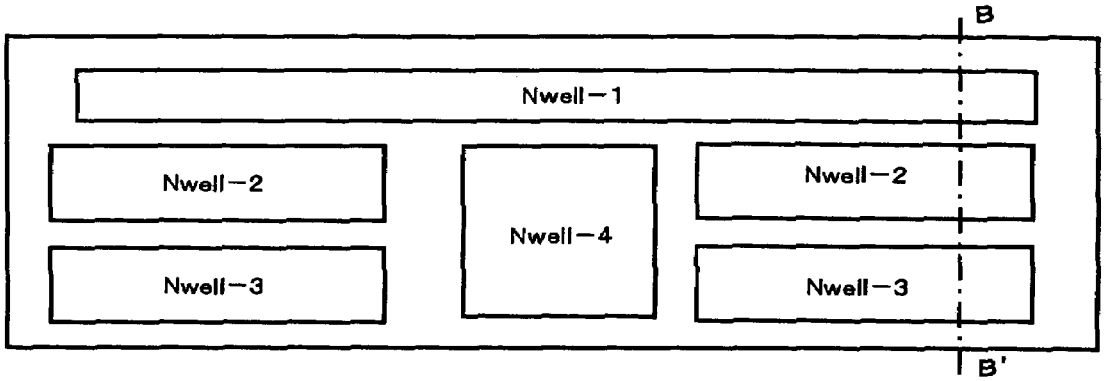
FIG. 27 is an area arrangement diagram of the first embodiment of the present invention.
Figure 28:
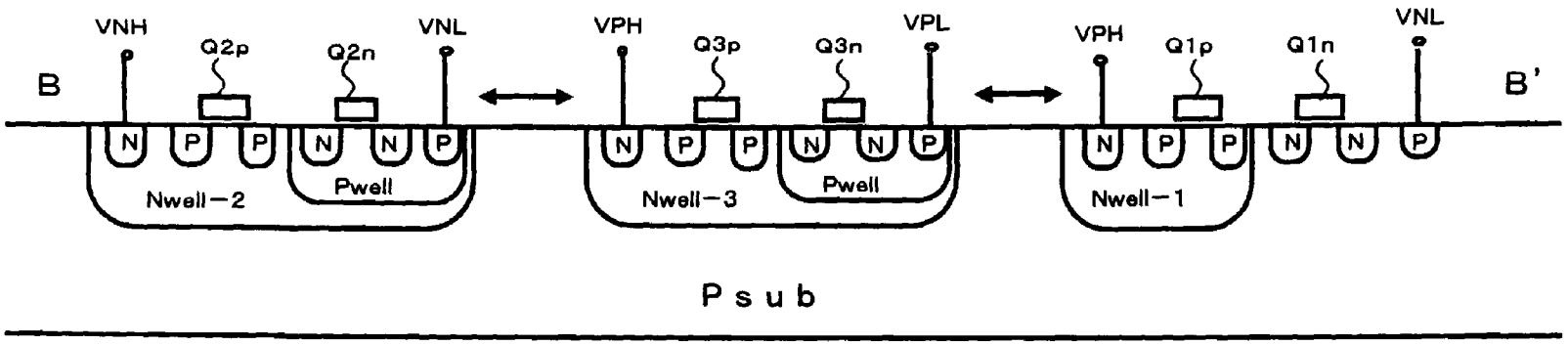
FIG. 28 is a cross-sectional view of a semiconductor circuit device of the first embodiment of the present invention.

In the arrangement shown in FIG. 27, the positive polarity drive circuit 10 (N-well-3) and negative polarity drive circuit 20 (N-well-2) are disposed above and below a line parallel to the X axis. FIG. 28 is cross-sectional view along the B-B' line in FIG. 27. It goes without saying, that the positive polarity drive circuit 10 and negative polarity drive circuit 20 may be arranged in the left-right configuration inverted with respect to the right-left configuration shown in FIG. 23, and they also may be arranged in the bottom-top configuration inverted with respect to the top-bottom configuration shown in FIG. 27. Further, the substrate may be an Nsub (N-type substrate). In this case, the Nsub is set to the highest voltage of VPH or the like.

Embodiment 2

Figure 29:
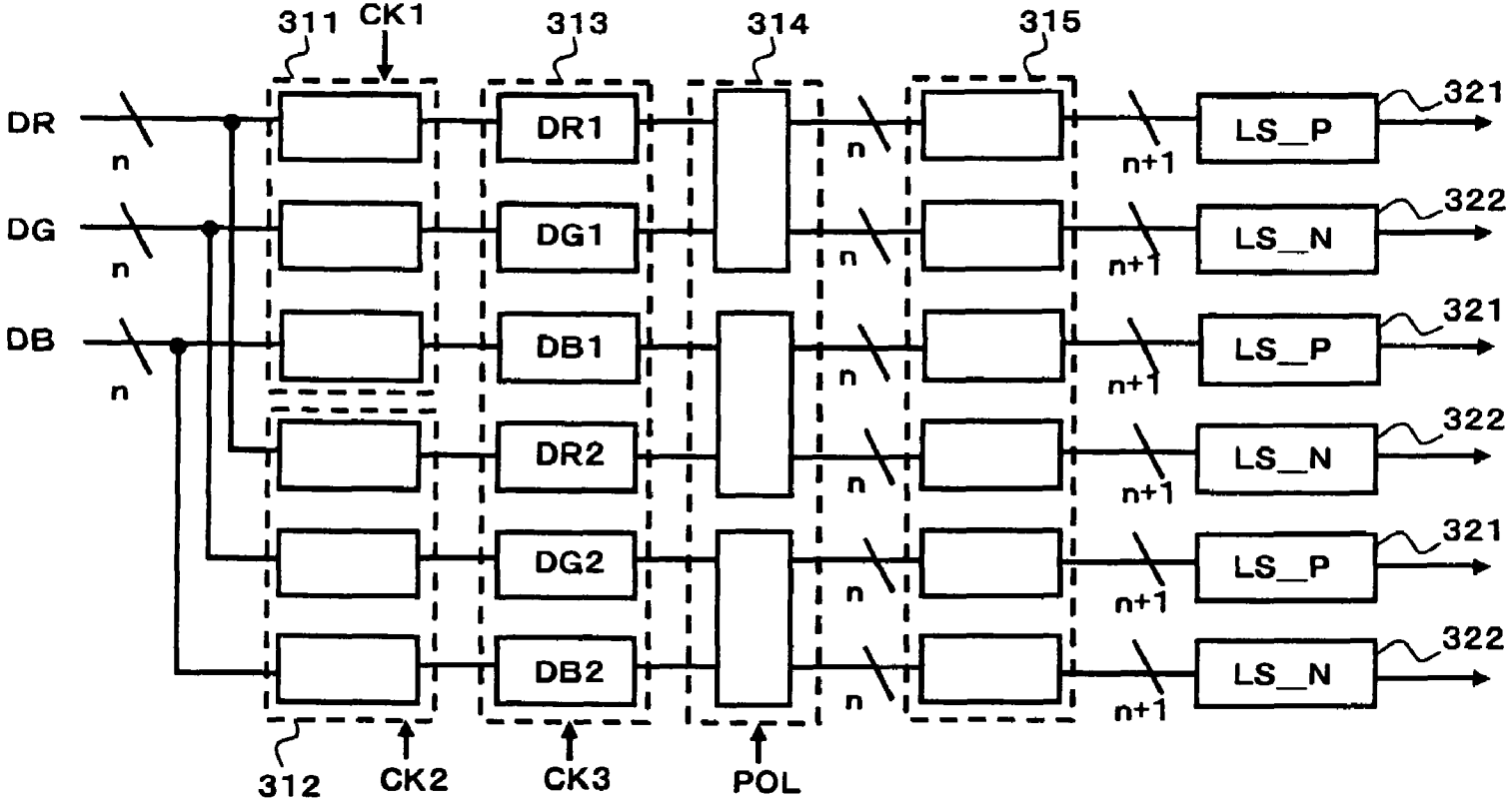
FIG. 29 is a block diagram of the picture signal circuit of the second embodiment of the present invention.

In Embodiment 1, the signal generated by the signal processing circuit 31 is inputted into the positive polarity drive circuit 10 and negative polarity drive circuit 20 via the level shift circuit 32, however, because the inputted signal is a level-shifted voltage, the consumption of power in the picture signal bus is increased. However, as shown in FIG. 29, the increase in power consumption in the picture signal bus can be inhibited by providing a data inversion circuit 315 between the picture signal switching circuit 314 and level shift circuit 32.

The data inversion circuit 315 comprises a circuit for latching and comparing previous data with next data for each picture signal, a circuit for inverting the picture signal according to the comparison results, and a circuit for generating a video inverted signal INV. The data inversion circuit 315, according to the majority operation, compares the previous data and data subsequent thereto and sets the image inverted signal INV to 0 when more than half of bits are inverted and sets the image inverted signal INV to 1 when the number of inverted bits is equal to or less than half. Further, in the present embodiment, the circuits of the initial stage of the data register circuits 12, 22 are exclusive logical circuits.

For example, when the picture signal is a 6-bit signal, if the previous data is 000011 and the next data is 111111, the picture signal with 4 bits of the 6 bits is inverted. Therefore, power consumption is inhibited by inverting 2 bits and obtaining 000000, rather than by inverting 4 bits and obtaining 111111. Accordingly, the video inverted signal INV is set to 0 and the picture signal inputted into the positive polarity level shift circuit 321 or negative polarity level shift circuit 322 is inverted to 000000 and inputted into the positive polarity data register circuit 12 or negative polarity data register circuit 22. Further, the picture signal is inverted to 111111 and latched according to the video inverted signal INV in the positive polarity data register circuit 12 or negative polarity data register circuit 22.

If the previous data is 000011 and the next data is 110011, only a picture signal of 2 bits of the 6 bits is inverted. Therefore, the procedure is inverted with respect to the above-described one. The video inverted signal INV is set to 1 and the picture signals inputted into the positive polarity level shift circuit 321 or negative polarity level shift circuit 322 is inputted "as is" as 110011. The picture signal is latched as 110011 according to the video inverted signal INV in the positive polarity data register circuit 12 or negative polarity data register circuit 22.

The consumed power is cv2f (c: capacitance, v: voltage amplitude, f: frequency). The capacitance c is almost doubled by changing the data register circuits from low-voltage elements to high-voltage elements. Furthermore, the voltage amplitude v is also doubled from 2.5V to 5V. Therefore, power consumption is increased by a maximum factor of 8. However, when 3 bits of the 6 bits are inverted with the data inversion circuit 315, the maximum power consumption is reduced to a four-fold increase. In the case of the same color over the entire screen, e.g., white color or black color, the picture signal does not change. Therefore, the power consumption is 0. With a 1-bit checked pattern, only the video inverted signal INV is inverted. Therefore, the power consumption is increased by a facture of 8/6=1.3. With the text information, a large number of black symbols are present against the white background. Therefore, the maximum increase factor is not more than about 1.3. Moreover, from the standpoint of the entire liquid crystal display device, the entire power consumption is that for driving the data lines 4 and scanning lines 5 and that in the D/A conversion circuits of the data line drive circuits, and the power consumption in the picture signal bus is at maximum less than 10% based on the entire power consumption. For this reason, even if the power consumption of the picture signal bus is increased by a factor of 1.3, the increase for the entire device is less than 3%. Setting the com voltage to GND improves the efficiency of the power source circuit of the drive system from 64% to 80%. Therefore, power consumption is reduced despite the cancellation.

Embodiment 3

Figure 30:
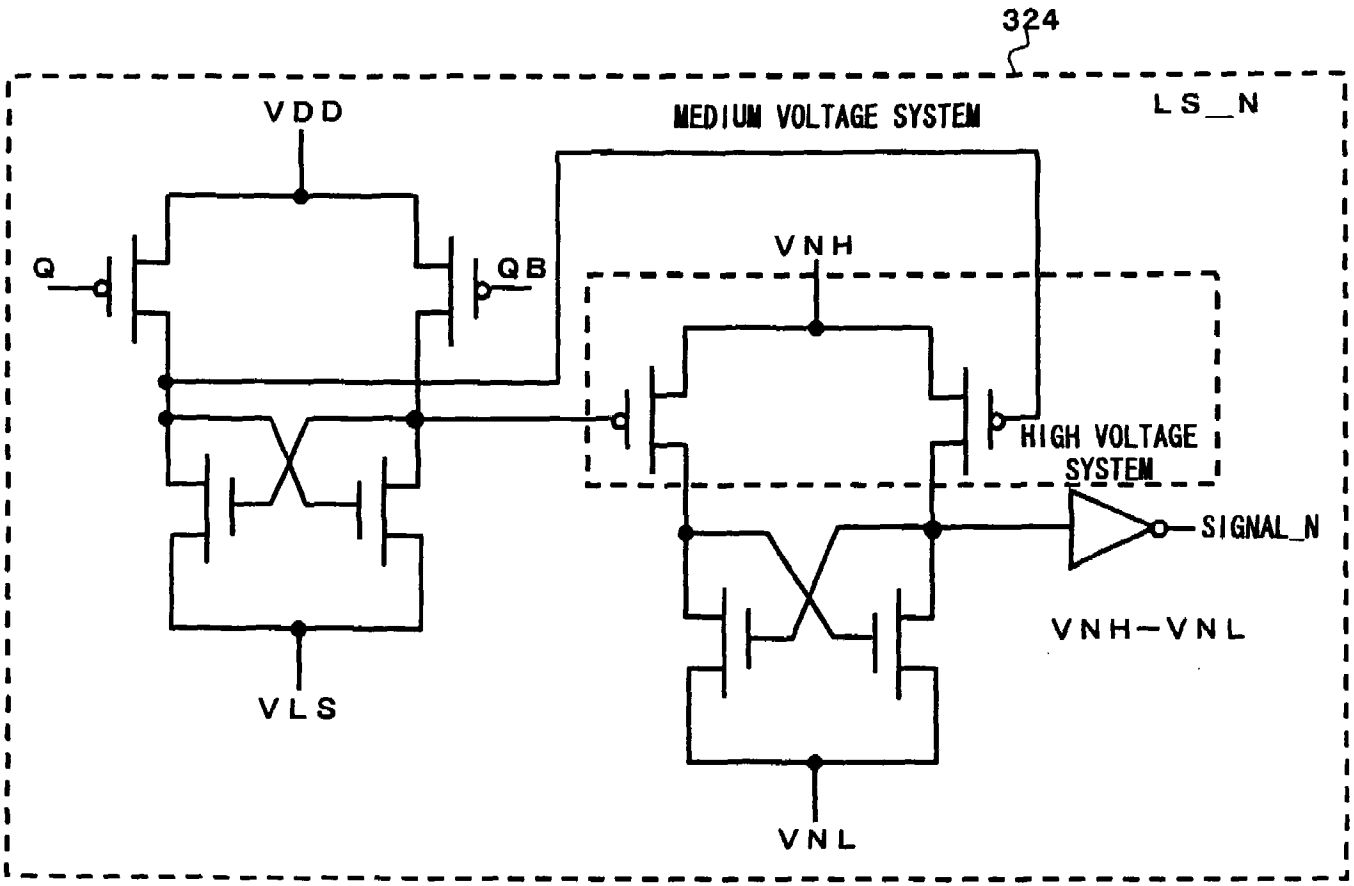
FIG. 30 is a detailed drawing of the negative polarity level shift circuit 324 of the third embodiment of the present invention.
Figure 31:
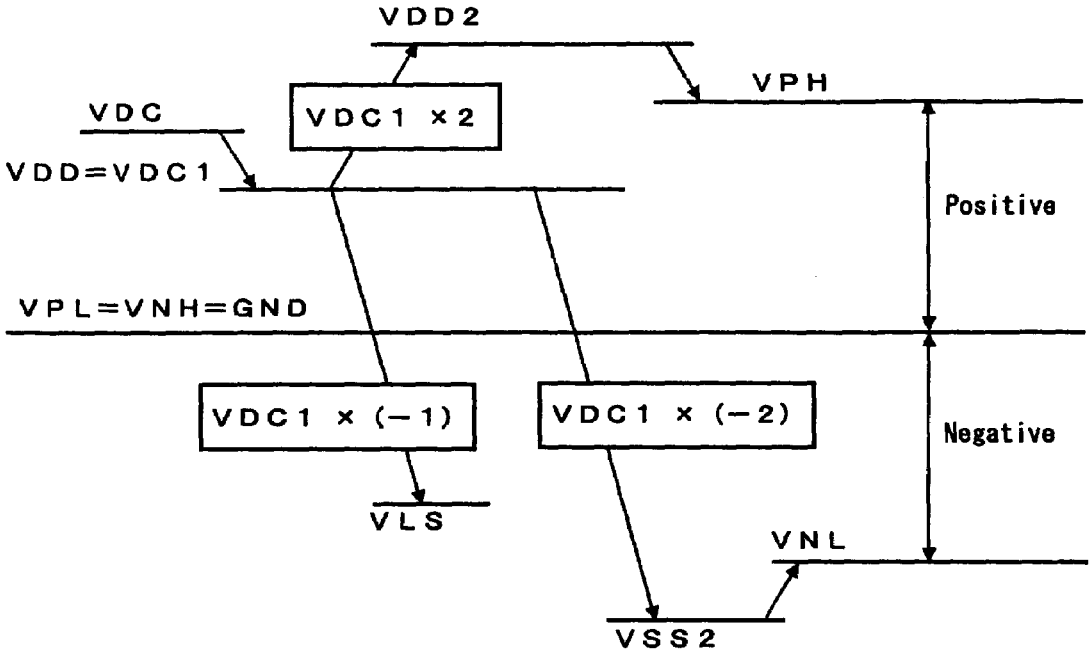
FIG. 31 is a correlation chart of power supply voltages of the third embodiment of the present invention.
Figure 32:
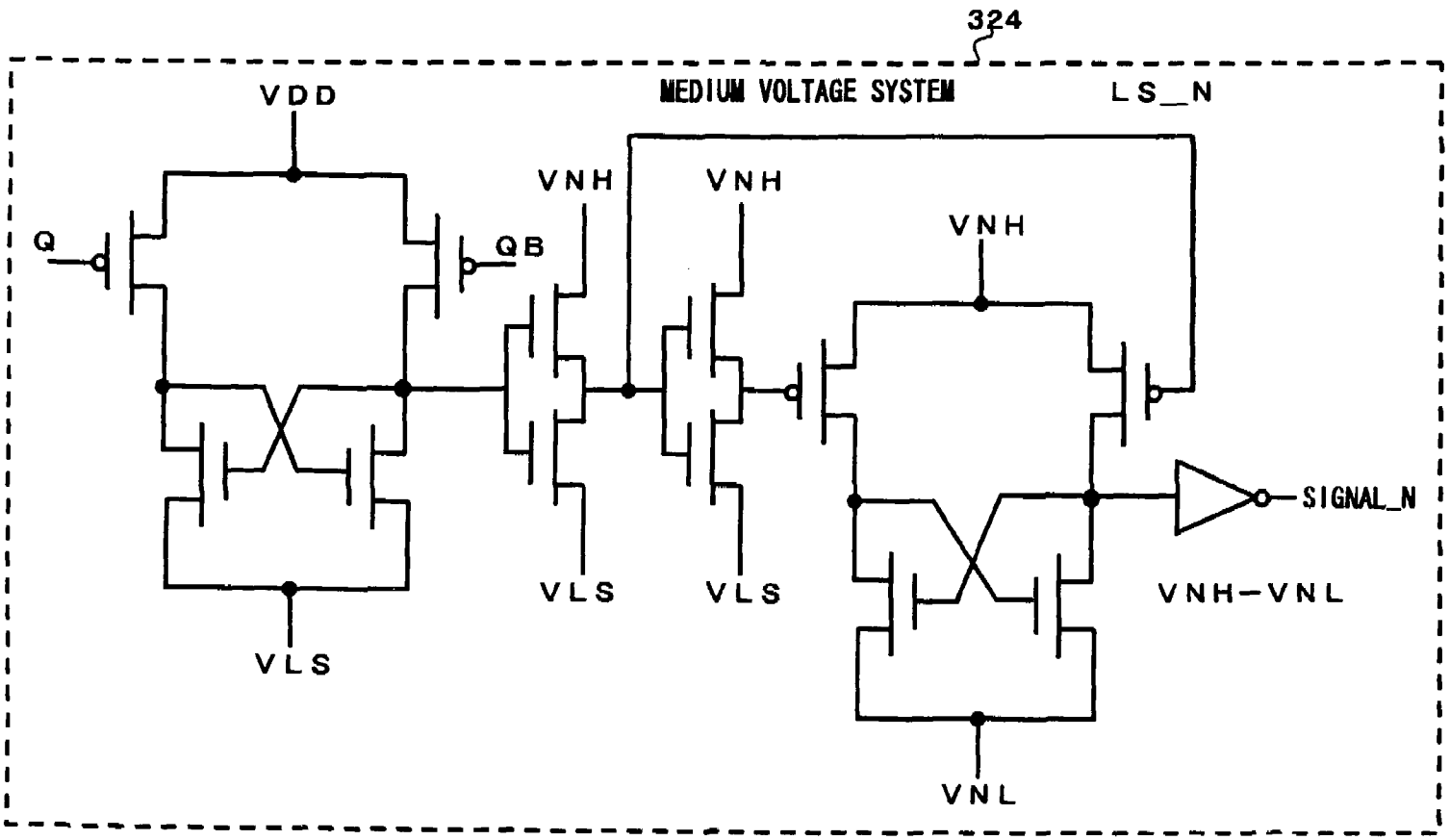
FIG. 32 is a detailed drawing of the negative polarity level shift circuit 324 of the third embodiment of the present invention.

FIG. 30 shows a negative polarity level shift circuit different from the negative polarity level shift circuit 322 explained in Embodiment 1. The negative polarity level shift circuit 322 is fabricated from high-voltage elements, however, the negative polarity level shift circuit 324 is fabricated from medium-voltage elements, except the second-stage P channel transistor. The difference between the negative polarity level shift circuits 322 and 324 is in that the low level voltage of the first-stage level shift circuit is VLS (−1.times.VDC1) (refer to FIG. 31) and the output of the first stage is inputted into the P channel transistor of the second-stage level shift circuit. Furthermore, referring to FIG. 32, an inverter operating at a voltage of VLS-GND may be inserted between the level shift circuit of the first stage and the level shift circuit of the second stage to fabricate all the elements of the level shift circuit with medium-voltage elements.

Figure 33:
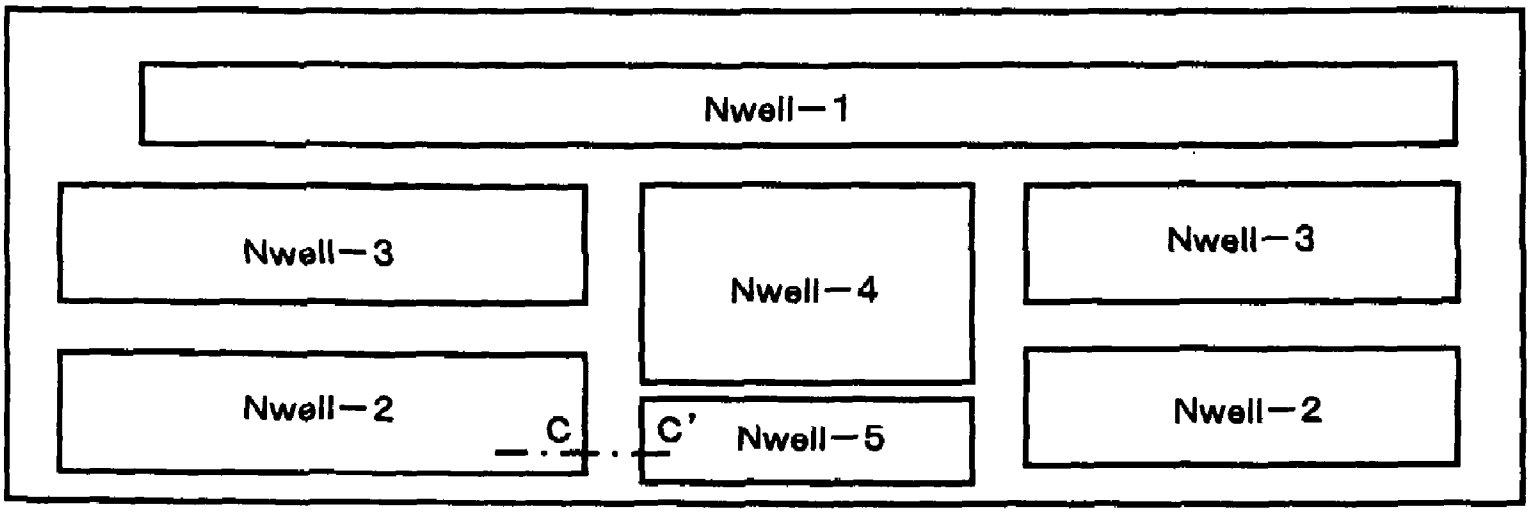
FIG. 33 is an area arrangement diagram of the third embodiment of the present invention.
Figure 34:
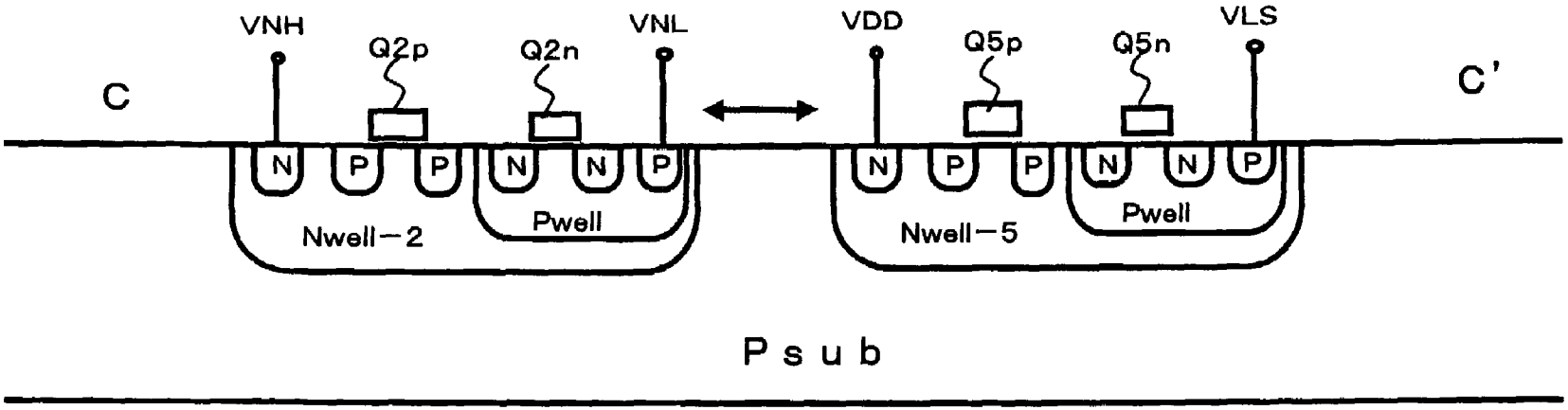
FIG. 34 is a cross-sectional view of a semiconductor circuit device of the third embodiment of the present invention.

With such a circuitry, the level shift circuit of the first stage and the level shift circuit of the second stage are fabricated on different N-well. FIG. 33 shows the N-well arrangement of the present embodiment. FIG. 34 is a cross-sectional view along the C-C' line in FIG. 33. As shown in FIG. 34, the level shift circuit of the first stage is fabricated on the N-well-5 and the level shift circuit of the second stage is fabricated on the N-well-2, similarly to the negative polarity drive circuit 20. With such an embodiment, because the negative polarity level shift circuits are fabricated from medium-voltage elements, the element surface area can be reduced with respect to that attained when they are fabricated from high-voltage elements.

Embodiment 4

In Embodiments 1 through 3, the pre-charge switch 333 was provided after the switch 331 and switch 332 that are switching circuit. Therefore, one pre-charge switch 333 handles both a positive polarity voltage and a negative polarity voltage. As a result, the pre-charge switch 333 must be configured with high-voltage elements. In the present embodiment, a positive polarity pre-charge switch and negative polarity pre-charge switch are provided between the positive polarity drive circuit and the switching circuit and between the negative polarity drive circuit and the switching circuit, respectively, so that the pre-charge switches can be fabricated from medium-voltage elements by preparing pre-charge circuits for positive polarity and negative polarity and the circuit scale can be further reduced. In the present embodiment, some components have a location different from that explained in Embodiment 1 by using FIG. 15, FIG. 16, and FIG. 21, and the explanation of the components assigned with identical symbols will be omitted.

FIGS. 35A to 35D illustrate the switching operation of the pre-charge switch (145, 245) and switching circuit 33 of the present embodiment. FIGS. 35A to 35D show consecutive changes in the connection stage of switches with time. The functions of the switch 331 and switch 332 in the switching circuit 33 are identical to those of the example explained with reference to FIG. 16. The pre-charge switch 145 and pre-charge switch 245 are used instead of the pre-charge switch 333 of Embodiment 1. Thus, the pre-charge switch 145 and pre-charge switch 245 are connected to respective prescribed voltages and the data lines are connected to the prescribed voltages, thereby providing for a pre-charge to the prescribed voltage and preventing the application of a voltage exceeding the breakdown voltage to the positive polarity D/A conversion circuit 14 and negative polarity D/A conversion circuit 24. As shown in the figure, the pre-charge switch 145 is connected to the positive polarity D/A conversion circuit 14, and the pre-charge switch 245 is connected to the negative polarity D/A conversion circuit 24. Further, the pre-charge switch 145 is connected to the VPL voltage, and the pre-charge switch 245 is connected to the VNH voltage.

Figure 35A:
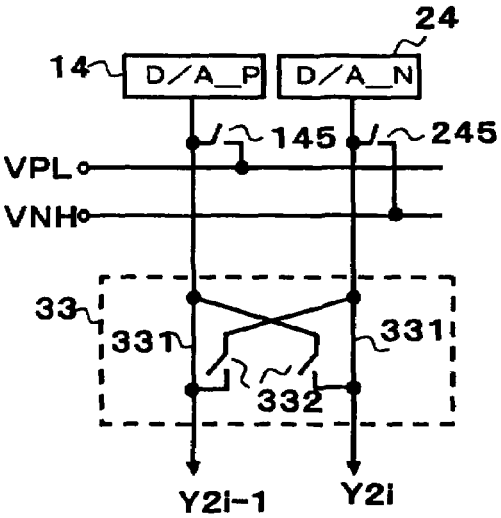
FIGS. 35A-35D show detailed drawings of the pre-charge switch of the fourth embodiment of the present invention.
Figure 35B:
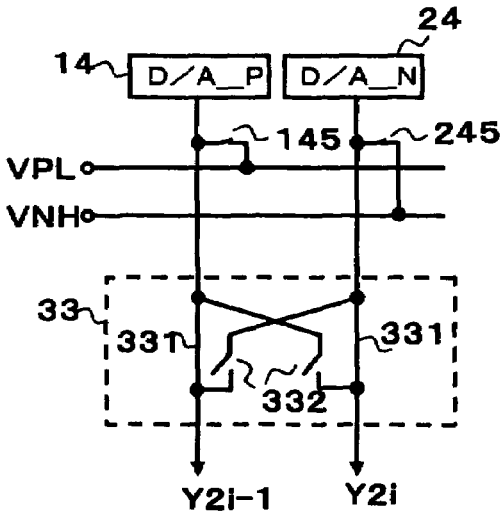

Further, each state shown in FIGS. 35A through 35D will be explained with reference to FIG. 36. The timing chart shown in FIG. 36 corresponds to FIG. 21 of Embodiment 1, and the timing of the pre-charge switch 145 and pre-charge switch 245 is shown instead of the timing of the pre-charge switch 333. FIG. 35A shows a switch state at a timing where the latch signal STB is L and the polarity signal POL is H. The positive polarity picture signals are outputted from the output terminals Y2*i*−1 of odd numbers, and the negative polarity picture signals are outputted from the output terminal Y2*i* of even numbers. FIG. 35B shows the connection state at the time when the latch signal STB is H and the polarity signal POL is L. The pre-charge switch 145 and pre-charge switch 245 are switched ON and the output terminals Y2*i*−1, 2*i* are pre-charged to the VPL voltage and VNH voltage, respectively.

Figure 35C:
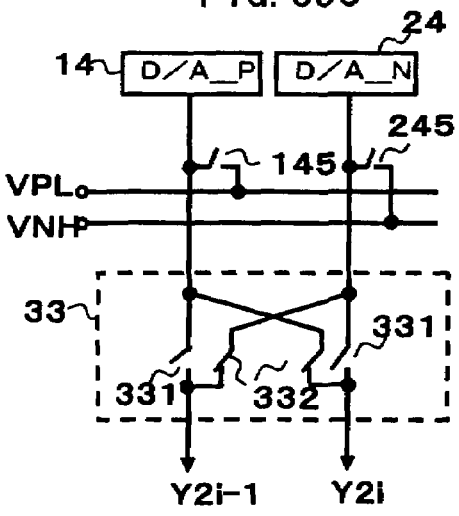
Figure 35D:
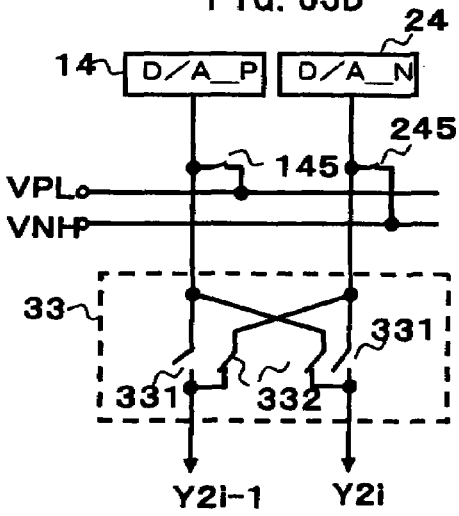
Figure 36:
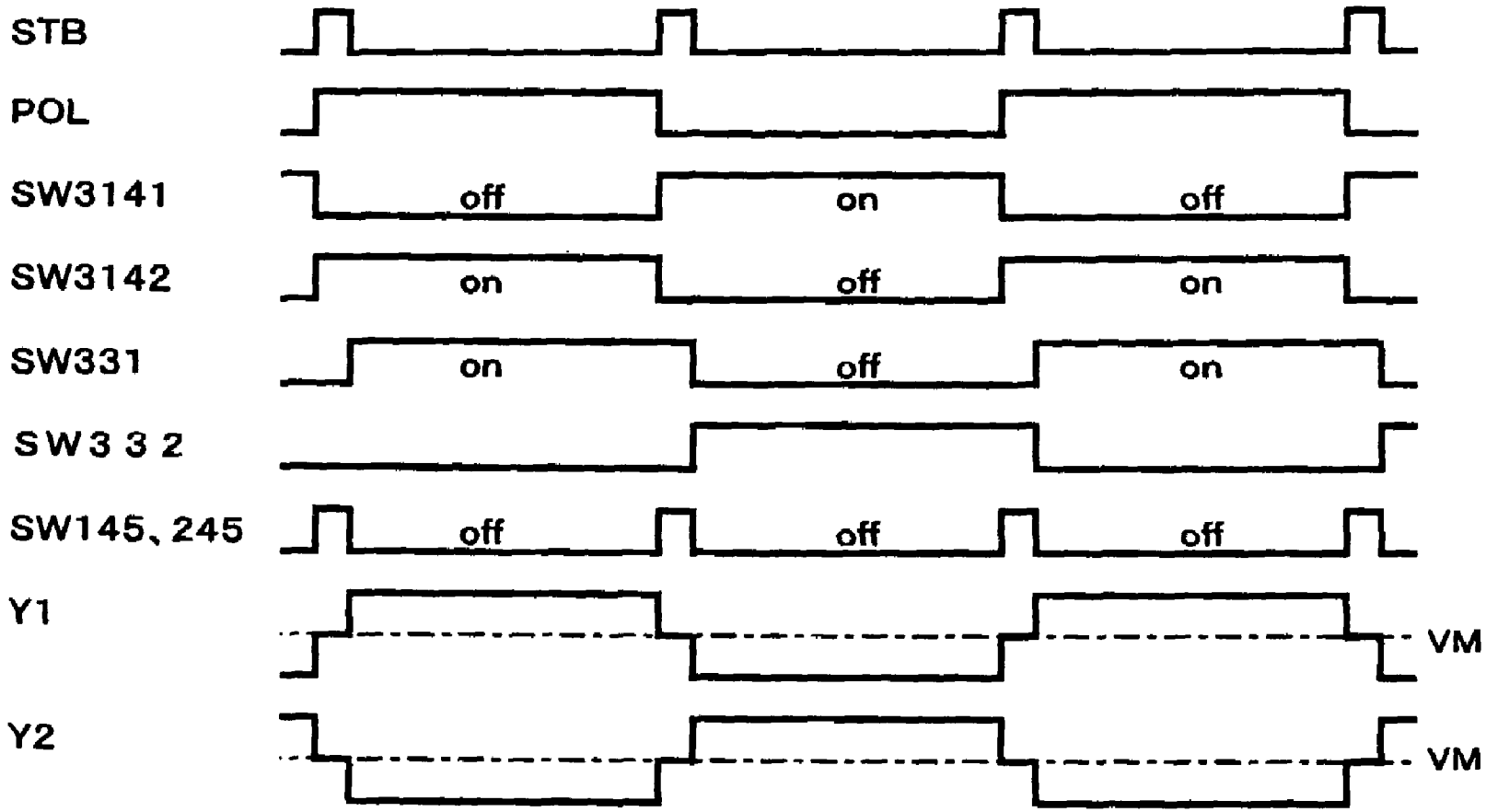
FIG. 36 is a timing chart of the fourth embodiment of the present invention.
Figure 37A:
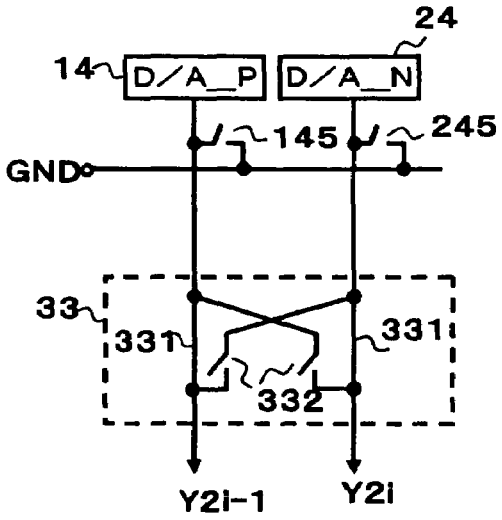
FIGS. 37A-37D show detailed drawings of the pre-charge switch of the fourth embodiment of the present invention.
Figure 37B:
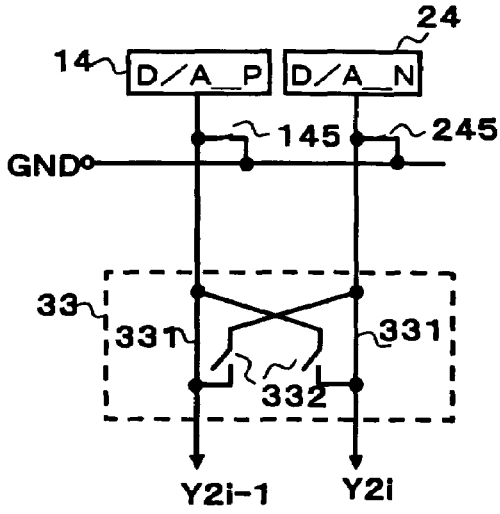
Figure 37C:
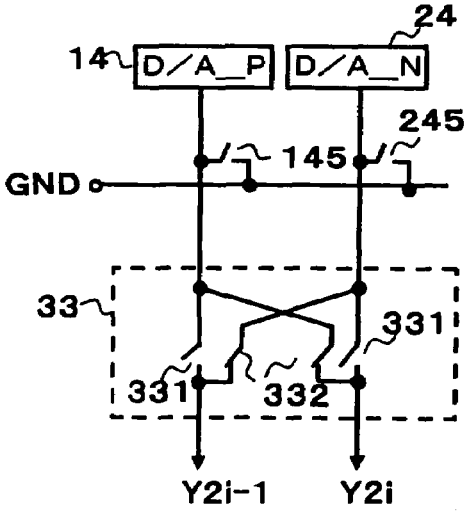
Figure 37D:
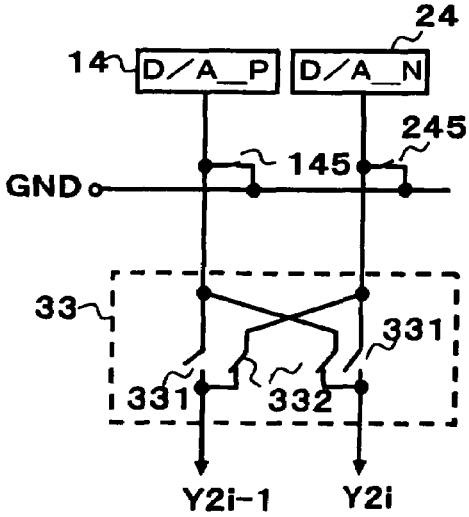

FIG. 35C shows the state in which the latch signal STB became L. The pre-charge switch 145 and pre-charge switch 245 are switched OFF and the negative polarity picture signals are outputted from the output terminals Y2*i*−1 with the odd numbers and the positive polarity picture signals are outputted from the output terminal Y2*i* with the even numbers by ON/OFF switching the switches 331 and 332. FIG. 35D shows the state corresponding to the next timing in which both the latch signal STB and the polarity signal POL are H. The pre-charge switch 145 and pre-charge switch 245 are switched ON and the output terminals (Y2*i*–1, 2*i*) are pre-charged to a VNH voltage and a VPL voltage, respectively. In the next timing, the latch signal STB becomes L and returns to the state shown in FIG. 35A.

As described above, before the switch 331 and switch 332 are switched OFF, the pre-charge switch 145 and pre-charge switch 245 are switched ON. As a result, the voltage applied to the output terminals (data lines) of the D/A conversion circuit 14 and D/A conversion circuit 24 is short circuited to the VPL or VNH, respectively (pre-charging). Therefore, the control is so conducted that the voltage exceeding the breakdown voltage is not applied to the D/A conversion circuit 14 and D/A conversion circuit 24. Because the pre-charge switch 145 and pre-charge switch 245 may correspond to the positive polarity and negative polarity voltage, respectively, they can be fabricated from medium-voltage elements rather than high-voltage elements and the circuitry scale can be reduced. Further, the VPL and VNH can be at a system GND. FIGS. 37A-37D depict the circuit structure and its switching operation of this case in detail. Since the operation is identical to the circuit in FIGS. 35A-35D, the explanation is omitted.

Embodiment 5

In Embodiments 1 through 4, the digital picture signals that were inputted in serial are expanded and held as digital signals in parallel with the data register circuits and data latch circuits. In the present embodiment, an example will be explained in which the digital picture signals that were inputted in serial are converted into analog picture signals and those analog picture signals are expanded and held in sample and hold circuits to drive the data lines. With such a configuration, the number of data lines (n data lines were required in the case of n-bit digital signals) can be reduced to one analog data line. Therefore, the number of data lines can be decreased and, therefore, the circuitry scale can be reduced.

Figure 38:
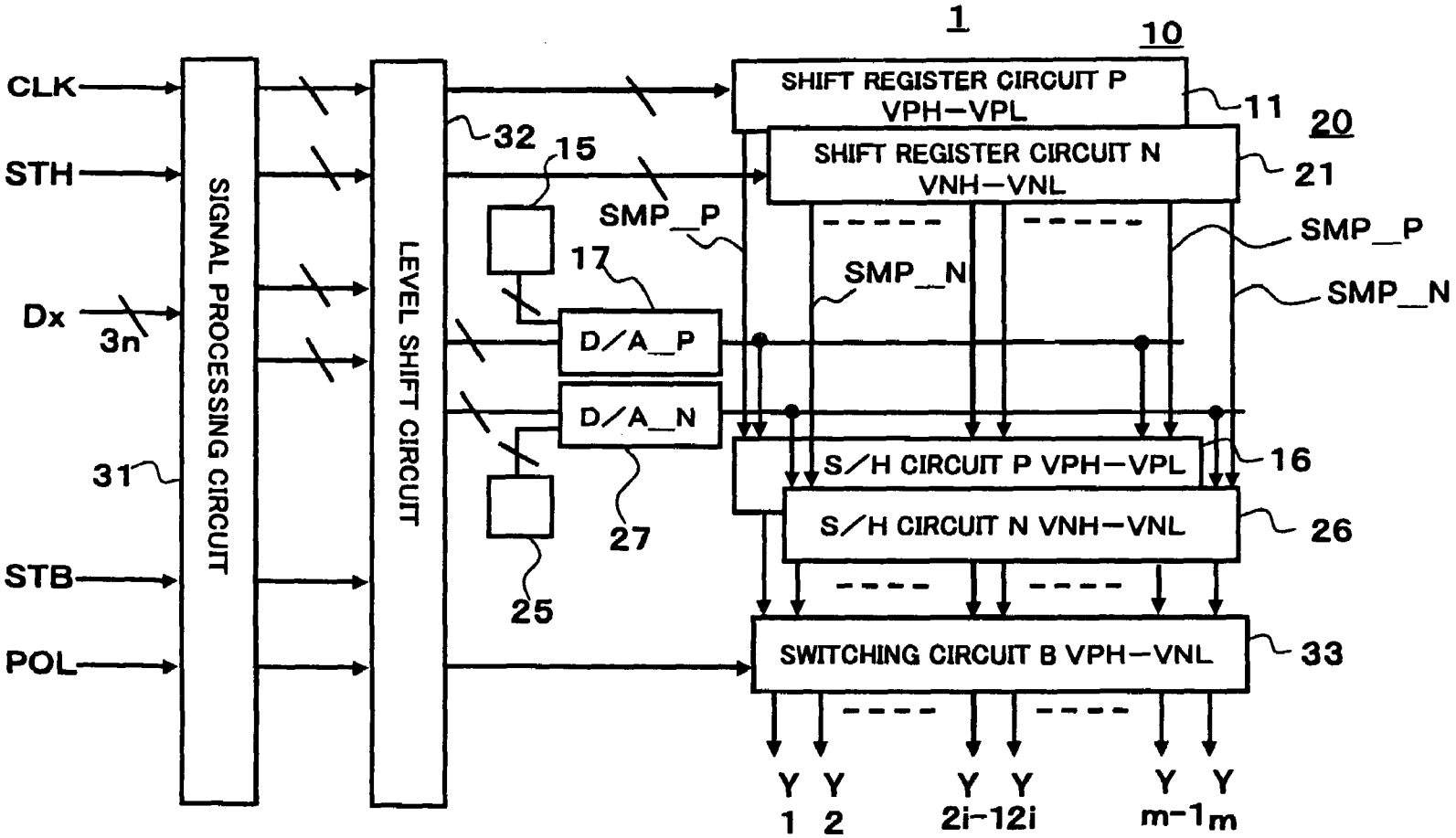
FIG. 38 is a block diagram of the data line drive circuit of the fifth embodiment of the present invention.

FIG. 38 is a block diagram showing a data line drive circuit device of a liquid crystal display device of the present embodiment. Sample hold circuits 16, 26 are provided instead of the data register circuits 12, 22 and data latch circuits 25 13, 23 of Embodiments 1 through 4. Further, D/A conversion circuits 17, 27 are provided instead of the D/A conversion circuits 14, 24 between the level shift circuit 32 and sample and hold circuits 16, 26. Furthermore, gradation voltage generation circuits 15, 25 are connected to the D/A conversion circuits 17, 27. The serial digital picture signal that was shifted to a positive polarity or negative polarity with the level shift circuit 32 is converted into an analog signal in the D/A conversion circuits 17, 27, and successive sampling thereof is conducted according to a clock in the sample and hold circuits 16, 26. The digital picture signals that were inputted in serial is thus converted into the analog picture signals, and these analog picture signals are expanded and held in the sample and hold circuits. At this time, it is determined whether the sampling be conducted in the positive polarity sample and hold circuit 16 with the SMP signal outputted from the shift register circuits 11, 21, or the sampling be conducted in the negative polarity sample and hold circuit 26. Positive/negative switching is thereafter conducted with the switching circuit 33 and the signal is outputted.

Figure 39:
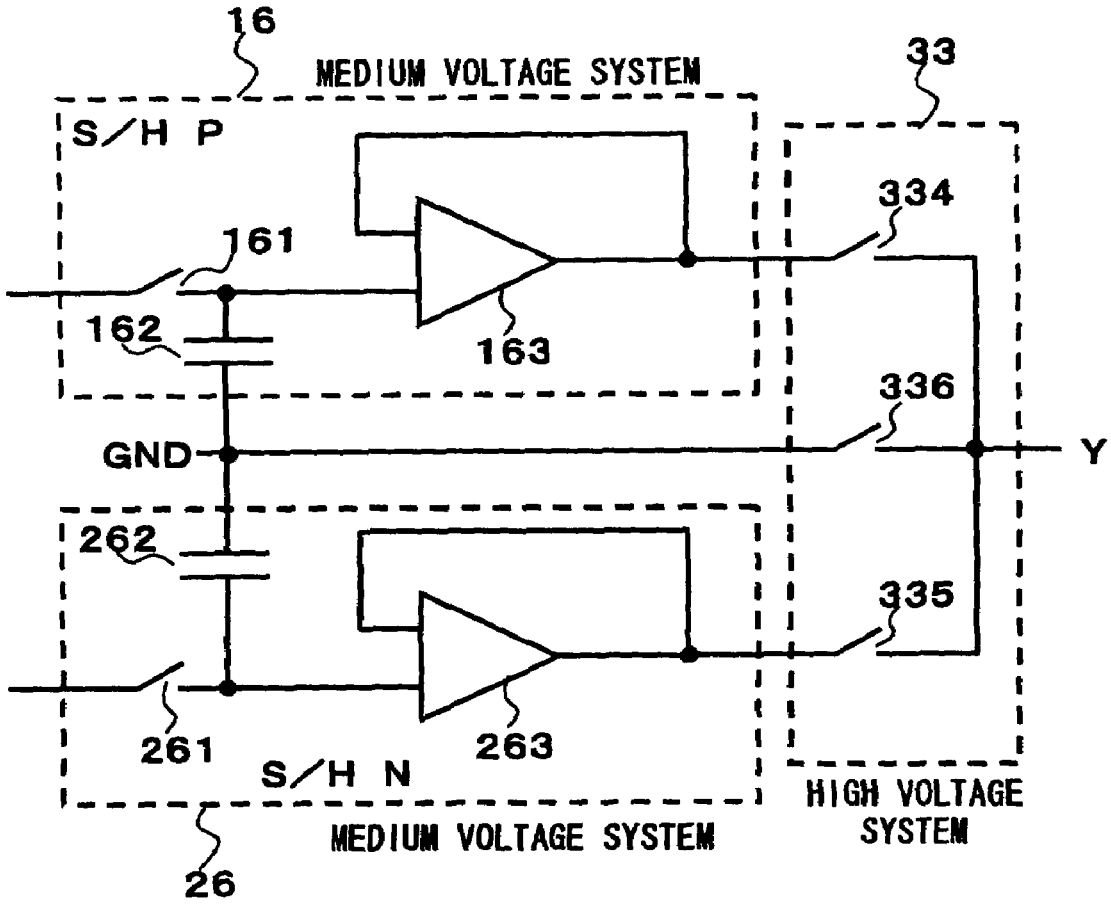
FIG. 39 shows a sample and hold circuit of the fifth embodiment of the present invention.

FIG. 39 shows in detail the sample and hold circuits 16, 26 and switching circuit 33 corresponding to one data line (pixel) Two sample and hold circuits 16, 26 for a positive polarity and negative polarity are connected to one data line. In each sample and hold circuit 16, 26, a positive polarity amplifier (voltage follower) 163 is provided between the switch 161 and switch 334, and a negative polarity amplifier (voltage follower) 263 is provided between the switch 261 and switch 335. A capacitor 162 for storing (sampling) the positive polarity analog signals is connected between the switch 161 and GND, and a capacitor 262 for storing (sampling) the negative polarity analog signals is connected between the switch 261 and GND.

The switches 161, 261, capacitors 162, 262, and amplifiers 163, 263 are fabricated from medium-voltage elements. The switches 161, 261 are switched by the sampling signal SMP imputed from the shift register circuits 11, 21. Furthermore, the switches 334, 335, 336 constituting the switching circuit 33 are fabricated from high-voltage elements. The switch 334 outputs a positive polarity analog picture signal, the switch 335 outputs a negative polarity analog picture signal, and the switch 336 is pre-charged to GND so that a voltage exceeding the operation voltage is not applied to the positive polarity amplifier 163 and negative polarity amplifier 263. In Embodiments 1 thorough 4, the switching circuit 33 selected the positive polarity and negative polarity analog picture signals by being commonly used by the two output terminals, however, in the present embodiment, swatches 334, 335, 336 are provided for each output terminal.

Figure 40:
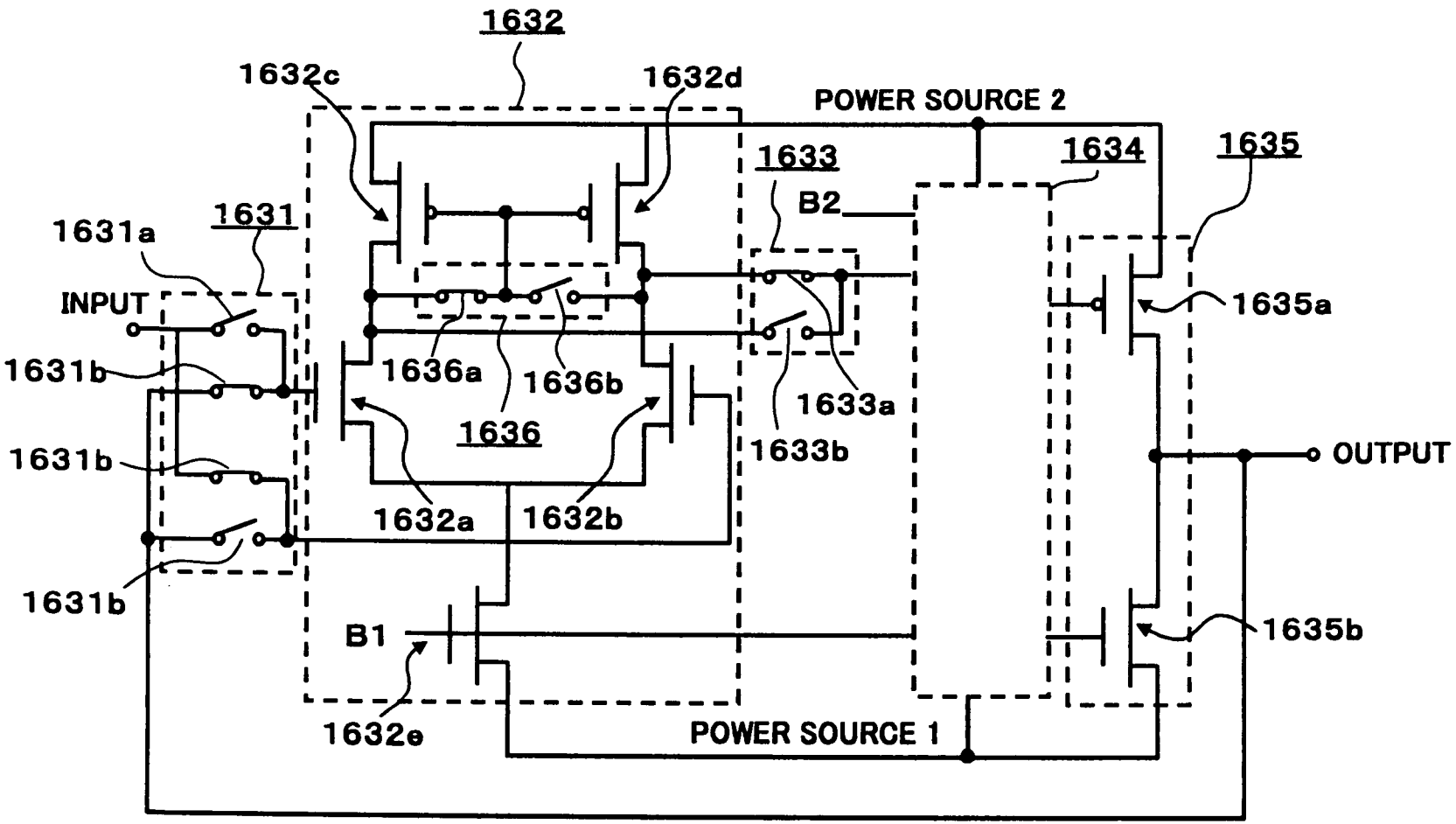
FIG. 40 is a detailed drawing of an amplifier in the fifth embodiment of the present invention.

The problem associated with the above-described configuration, in which two amplifiers (voltage followers) 163, 263 are connected to one output terminal, is that thin vertical lines are displayed due to the variation of the offset voltage of the amplifier. For this reason, the offset voltage of the amplifier has to be cancelled between the frames. Accordingly, a switching circuit for switching differential inputs (inverted input, non-inverted input) shown in FIG. 40 is preferably provided in the amplifiers 163, 263. FIG. 40 shows a configuration example of the amplifier equipped with a switching circuit for switching the differential inputs. The amplifier comprises an input switching circuit 1631, a differential amplification stage 1632, an output switching circuit 1633 of the differential amplification stage, a circuit 1634 of the intermediate stage comprising a source ground circuit, and an output stage 1635 composed of PMOS transistors 1635*a, b*. The symbols B1 and B2 stand for bias voltages. The differential amplification stage 1632 comprises a differential pair composed of NMOS transistors 1632*a, b*, a current mirror circuit composed of PMOS transistors 1632*c, d*, and an NMOS transistor 1632 connected to the tail side of the differential pair. Further, it also comprises a switching circuit 1636 for switching the gate connection of the current mirror circuit.

The input switching circuit 1631 comprises four switches 1631*a-d*, and the input signal to the differential amplification stage 1632 and feedback from the output are connected to one respective transistor of the differential pair. In the configuration shown in the figure, the switches 1631*b, d* are switched ON, the switches 1631*a, c* are switched OFF, the input signal is inputted into the NMOS transistor 1632*b*, and the output is feedback supplied to the NMOS transistor 1632*a*. The switch 1636*a* of the switching circuit 1636 is ON, the switch 1636*b* is OFF, the switch 1633*a* of the output switching circuit 1633 is ON, and the switch 1633*b* is OFF. When the input switching circuit 1631 is switched and the differential input is switched, all the switches of the output switching circuit 1633 and switching circuit 1636 are switched. Thus, the variation of the offset voltage of the amplifier can be prevented by switching the differential input.

Figure 41:
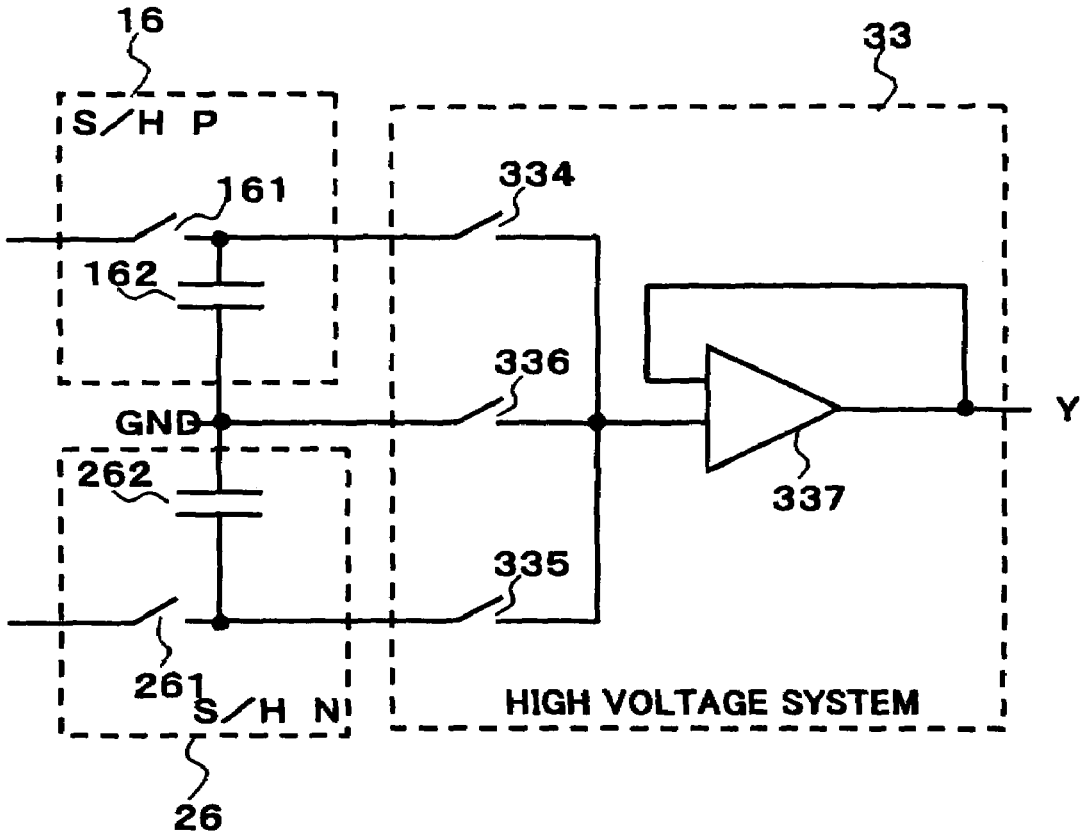
FIG. 41 shows an sample and hold circuit of the fifth embodiment of the present invention.

FIG. 41 shows in detail the switching circuit 33 and the sample and hold circuits 16, 26 different from those shown in FIG. 39. The sample and hold circuits 16, 26 do not comprise the amplifiers 163, 263, and the switching circuit 33 comprises one amplifier 337. The switch 161 and switch 334 and also the switch 261 and switch 335 are connected directly, without an amplifier, and an amplifier 337 fabricated from high-voltage elements is connected to other terminals (output side) of the switches 334, 335, 336. As for the offset voltage front during positive polarity voltage output and the offset voltage tail during negative polarity voltage output in the case of a configuration in which one amplifier (voltage follower) is connected to one output terminal, because the front is usually equal to the tail, the offset voltage is cancelled by an alternating current drive with positive polarity and negative polarity. Therefore, it is not necessary to use the switching circuit. However, because there is a charge distribution between the parasitic capacitor of the input portion of the amplifier 337 and the capacitors 162, 262, the gain is less than one and there is a spread in the gain. Therefore, it is preferred that the parasitic capacitance of the input portion of the amplifier 337 be as small as possible.

Figure 42:
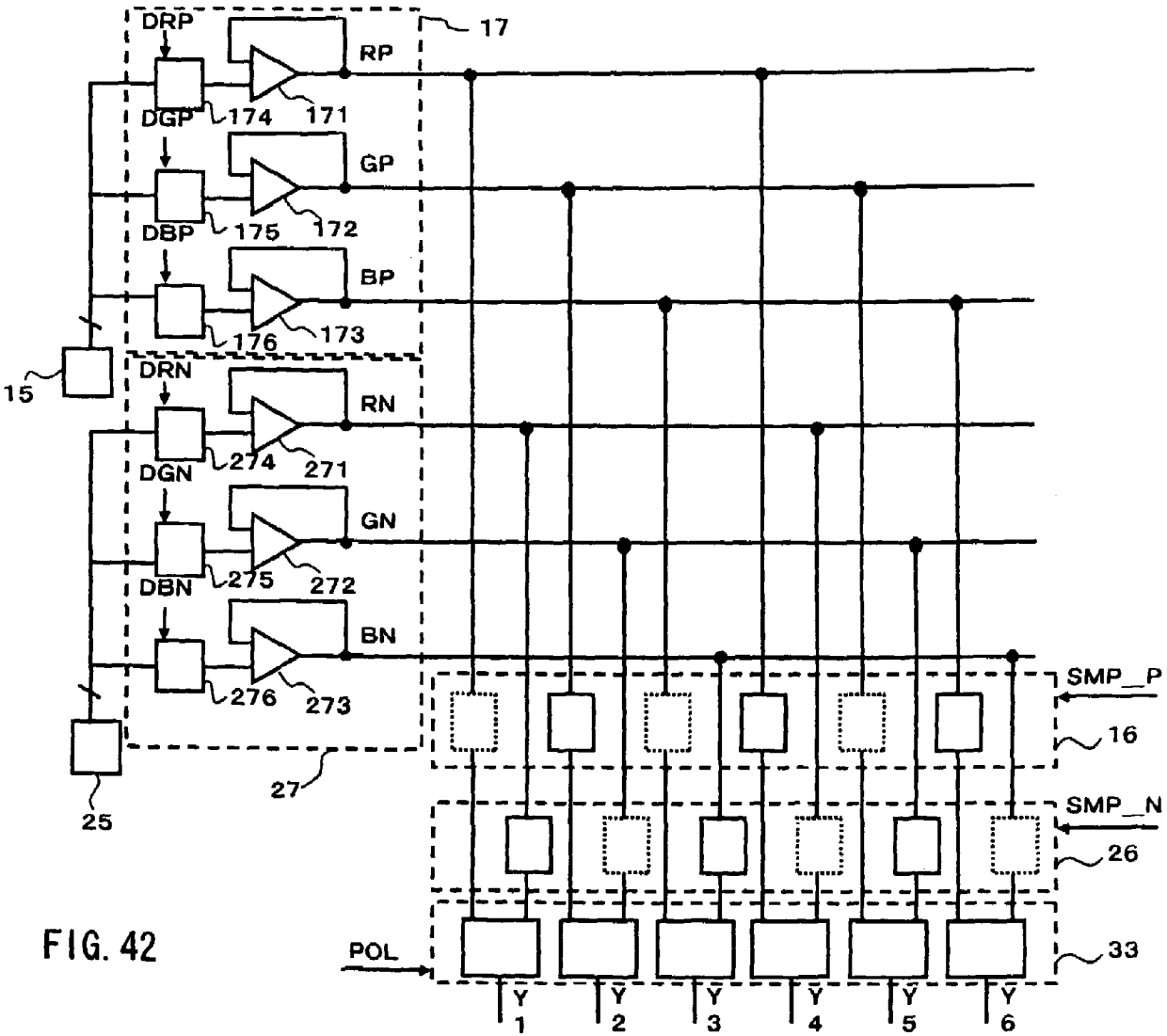
FIG. 42 is a detailed drawing of the D/A conversion circuit of the fifth embodiment of the present invention.
Figure 43:
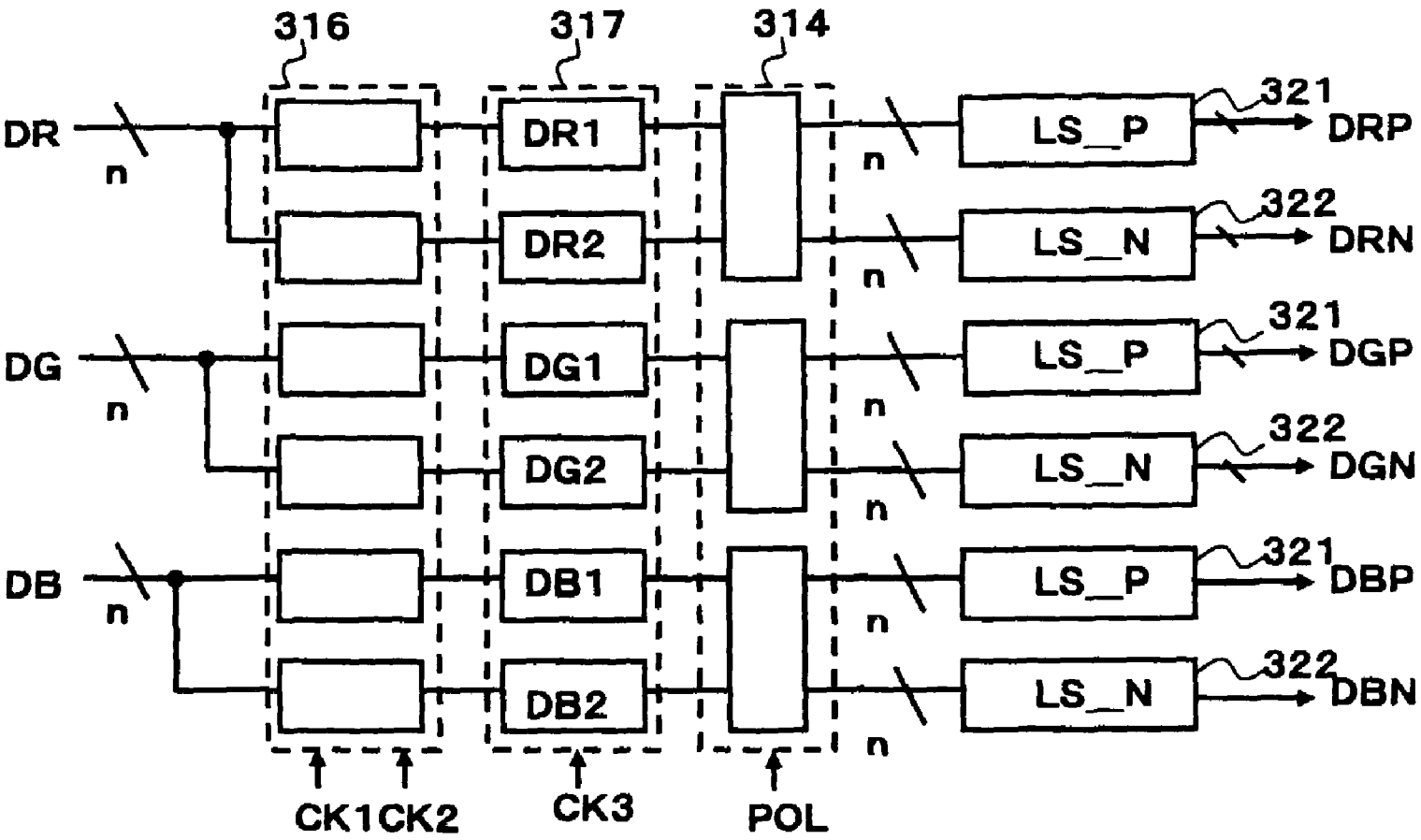
FIG. 43 is a block diagram of the picture signal circuit of the fifth embodiment of the present invention.

The positive polarity D/A conversion circuit 17 and negative polarity D/A conversion circuit 27, as shown in FIG. 42, select the gradation voltage corresponding to the serial digital picture signal due to the connection to the gradation voltage generation circuits 15, 25, and drive the data lines linked to the sample and hold circuits 16, 26 at a high speed with a voltage follower. Here, the signal processing circuit 31 and level shift circuit 32 are identical to the circuits of Embodiments 1 through 4 and detailed explanation thereof is herein omitted. The configuration thereof and the signals outputted therefrom are shown in FIG. 43. In FIG. 43, the reference numerals 316, 317 stand for latch circuits. The latch circuit 316 comprises two latch elements correspondingly to each picture signal of RGB, and one latch element selectively latches the inputted picture signals according to CK1 and CK2 signal. In other words, the picture signal of the first display element is latched by one latch element, and the picture signals of the second display element are latched by the other latch element.

The latch circuit 317 comprises latch elements corresponding to each latch element of the latch circuit 316, and the output from the latch circuit 316 is latched by the latch circuit 317 according to CK3. The latch circuit 317 latches at the same time the picture signals of the first display element (DR1, DG1, DB1) and the picture signals of the second display element (DR2, DG2, DB2). Other structural elements are identical to the elements that have already been explained. Because the data line drive circuit device in accordance with the present invention is of a dot inversion system, the polarity of the adjacent output terminals is inverted. This is made possible by the sampling signal SMP that is inputted from the shift register circuits 11, 21 and level shift circuit 32 to the sample and hold circuits 16, 26. As shown in FIG. 38 and FIG. 42, a positive polarity sampling signal SMP_P is inputted into the positive polarity sample and hold circuit 16 from the positive polarity shift register circuit 11, and a negative polarity sampling signal SMP_N is inputted into the sample and hold circuit 26 from the negative polarity shift register circuit 21.

In FIG. 42, the sample and hold circuits corresponding to each data line are drawn by dot line or solid line quadrangles inside the sample and hold circuits 16, 26. The difference between the dot lines and solid lines is the difference in reaction to the sampling signal SMP. For example, when the sampling signal SMP is "H", only the sample and hold circuit drawn by the dot lines conducts sampling, and when the sampling signal SMP is "L", only the sample and hold circuit drawn by the solid lines conducts sampling. Such an operation in response to the SMP signal may be inverted. The dot inversion is realized by switching the sampling signal SMP synchronously with the clock. Thus, in the example shown in FIG. 42, when the SMP signal is "H", the sample and hold circuit drawn by the dot lines conducts sampling. Therefore, the signals sampled by the positive polarity sample and hold circuit 16 are outputted to the output terminals Y1, Y3, Y5, and the signals sampled by the negative polarity sample and hold circuit 26 are outputted to the output terminal Y2, Y4, Y6.

Figure 44:
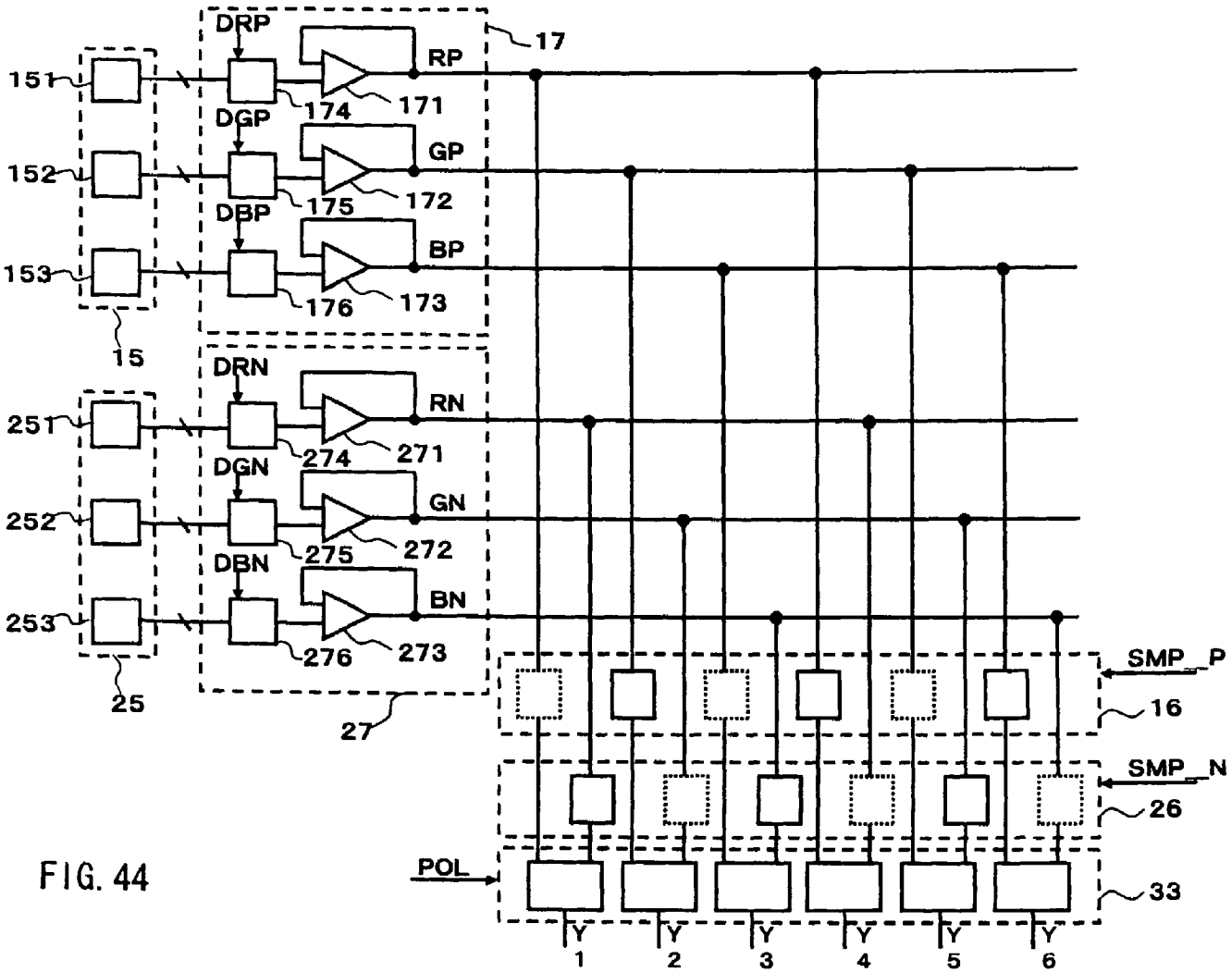
FIG. 44 is a block diagram of the D/A conversion circuit of the fifth embodiment of the present invention.

In the example shown in FIG. 42, the positive polarity D/A conversion circuit 17 and negative polarity D/A conversion circuit 27 comprise three positive polarity amplifiers 171, 172, 173 (for each RGB) and three negative polarity amplifiers 271, 262, 273 (for each RGB), respectively. Furthermore, the positive polarity D/A conversion circuit 17 also comprises decoders 174, 175, 176 correspondingly to respective amplifiers 171, 172, 173. Similarly, the negative polarity D/A conversion circuit 27 also comprises decoders 274, 275, 276 correspondingly to respective amplifiers 271, 272, 273. With QVGA pixels (240 RGB.times.320), if a blanking period is removed at a frame frequency of 60 Hz, then one horizontal period will be about 50 .mu.sec. Therefore, driving is conducted at 50 psec/120=416 nsec. Further, when each of the gradation voltage generation circuits 15, 25 comprises an independent gradation voltage generation circuit element for each RGB, as shown in FIG. 44, the circuit scale is increased, however, quality can be improved. In FIG. 44, the positive polarity gradation voltage generation circuit 15 comprises gradation voltage generation circuit elements 151, 152, 153 correspondingly to respective RGB. Similarly, the negative polarity gradation voltage generation circuit 25 comprises gradation voltage generation circuit elements 251, 252, 253 correspondingly to each RGB.

Figure 45:
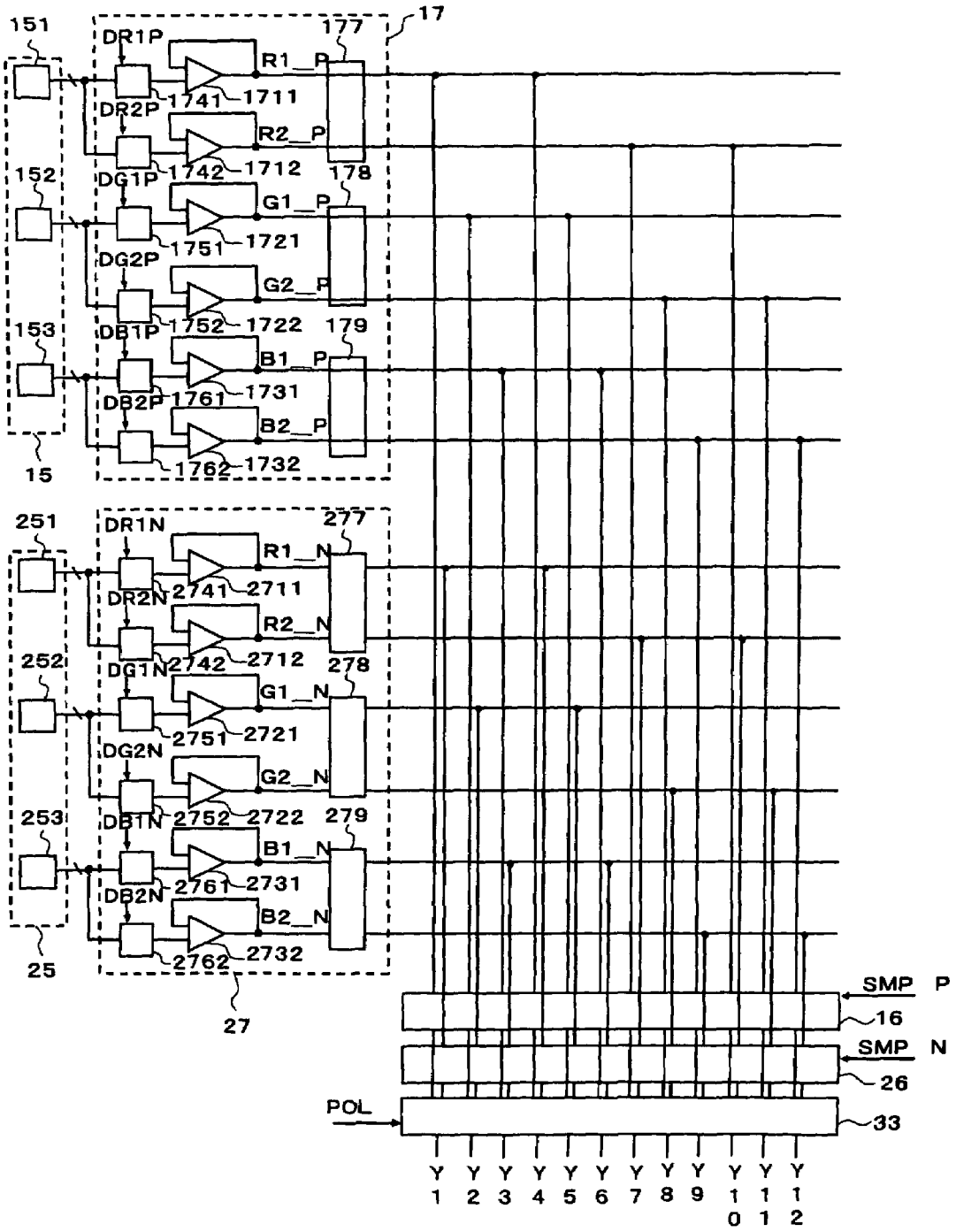
FIG. 45 shows a D/A conversion circuit of the fifth embodiment of the present invention.

When the number of pixels is large, it is preferred that the number of D/A conversion circuit elements be increased as shown in FIG. 45. In FIG. 45, each of the positive polarity D/A conversion circuit 17 and negative polarity D/A conversion circuit 27 comprises two D/A conversion circuit elements correspondingly to each RGB. The specific configuration will be described below. The positive polarity D/A conversion circuit 17 comprises an amplifier 1711 and a decoder 1741 corresponding thereto and an amplifier 1712 and a decoder 1742 corresponding thereto for the R. The output of the amplifier 1711 and amplifier 1712 is selectively outputted to the outside by the switching circuit 177. In the figure, the outputs of the amplifiers 1711, 1712 are outputted to the different lines. Thus, the output R1_P of the amplifier 1711 is outputted to the upper line (connection line of Y1, Y4) and the output R2_P of the amplifier 1712 is outputted to the lower line (connection line of Y7, Y10). Furthermore, there are provided an amplifier 1721 and a decoder 1751 corresponding thereto and an amplifier 1722 and a decoder 1752 corresponding thereto for G. The outputs of the amplifier 1721 and amplifier 1722 are selectively outputted to the outside by the switching circuit 178. The output G1_P of the amplifier 1721 is outputted to the upper line (connection line of Y2, Y5) and the output G2_P of the amplifier 1722 is outputted to the lower line (connection line of Y8, Y11) Furthermore, there are provided an amplifier 1731 and a decoder 1761 corresponding thereto and an amplifier 1732 and, a decoder 1762 corresponding thereto for B. The outputs of the amplifier 1731 and amplifier 1732 are selectively outputted to the outside by the switching circuit 179. The output B1_P of the amplifier 1731 is outputted to the upper line (connection line of Y3, Y6) and the output B2_P of the amplifier 1722 is outputted to the lower line (connection line of Y9, Y12).

Similarly, the negative polarity D/A conversion circuit 27 comprises two D/A conversion circuit elements correspondingly to each RGB. More specifically, it comprises an amplifier 2711 and a decoder 2741 and an amplifier 1722 and a decoder 2742 for the R. The outputs of the amplifier 2711 and amplifier 2712 are selectively outputted to the outside by the switching circuit 277. Furthermore, there are provided an amplifier 2721 and a decoder 2751 and an amplifier 2722 and a decoder 2752 for G. The outputs of the amplifier 2721 and amplifier 2722 are selectively outputted to the outside by the switching circuit 278. Furthermore, there are provided an amplifier 2731 and a decoder 2761 and an amplifier 2732 and a decoder 2762 corresponding thereto for B. The outputs of the amplifier 2731 and amplifier 2732 are selectively outputted to the outside by the switching circuit 279. The connection relationship of each amplifier and output line follows the rule similar to that of the D/A conversion circuit 17.

For example, in the case where a signal is outputted to the X1 line, the signals (R1_P, G1_N, B1_P, R1_N, G1_P, B1_N, R2_P, G2_N, B2_P, R2_N, G2_P, B2_N) are outputted into the (Y1, Y2, Y3, Y4, Y5, Y6, Y7, Y8, Y9, Y10, Y11, Y12), respectively. When the polarity is inverted for each line or each frame, the P, N of output polarity of each terminal is switched. In other words, the signals (R1_N, G1_P, B1_N, R1_P, G1_N, B1_P, R2_N, G2_P, B2_N, R2_P, G2_N, B2_P) are outputted into the (Y1, Y2, Y3, Y4, Y5, Y6, Y7, Y8, Y9, Y10, Y11, Y12), respectively. Switching of the outputs to each line is determined by each switching circuit. Thus, in one line, two D/A conversion circuit elements of the same polarity and same color output the signals alternately. The offset voltage of the amplifier can be dispersed in time and the occurrence of display defects can be prevented by preparing a plurality of D/A conversion circuit elements of the same color and same polarity and providing the switching circuits so that the D/A conversion circuit elements alternately output signals in the same line. Three or more D/A conversion circuit elements can be provided for each same polarity and same color. In this case, too, the D/A conversion circuit elements output the signals in turn (cyclically). At this time, the differential input (inverted input, non-inverted input) may be changed in each amplifier, as shown in FIG. 40.

Figure 46:
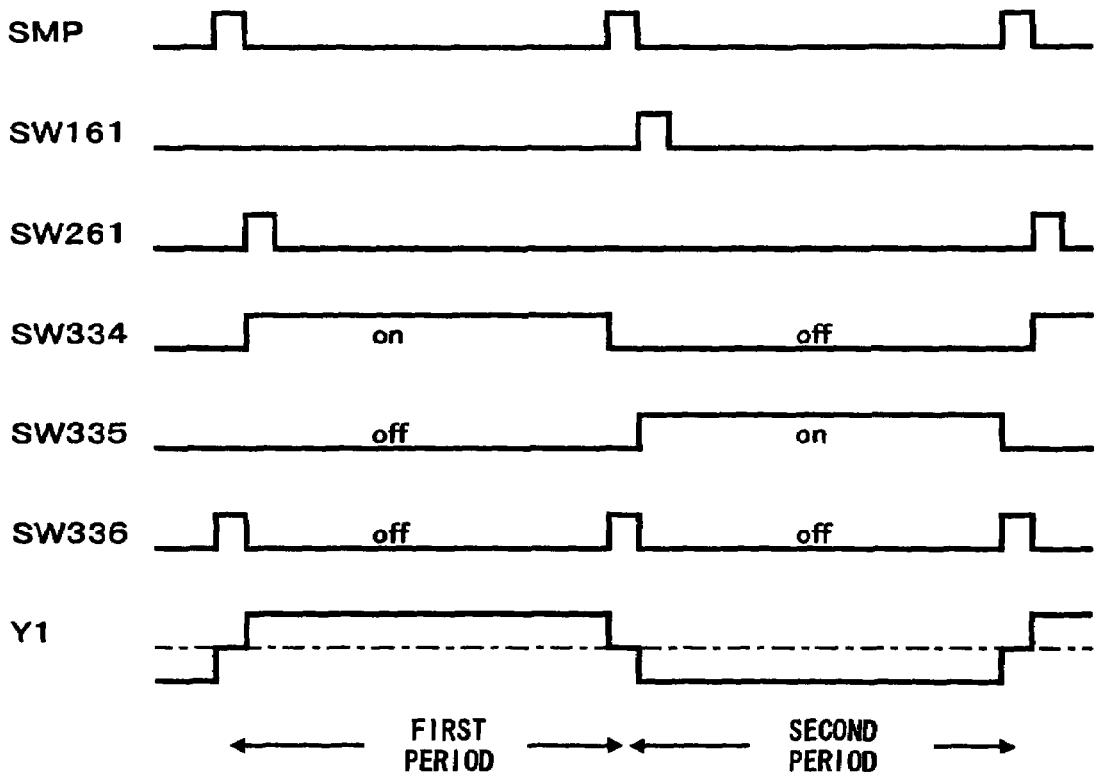
FIG. 46 is a timing chart of the fifth embodiment of the present invention.

The timing chart is shown in FIG. 46. The operation will be explained in detail by considering the output Y1 as an example. FIG. 46 shows the output Y1 and the operation timing of each switch for controlling the output Y1. As described hereinabove, in the dot inversion drive, the polarity differs for each adjacent data line. Therefore, the 2n-th and (2n−1)-th sampling switches 161, 261 are switched ON and sample the analog picture signals at respective different timings. Switching of the switches 161, 261 is conducted by the sampling signal SMP, as mentioned hereinabove. The output Y1 will be described as an example hereinbelow with reference to FIG. 46. The output Y2 will be also discussed. The following reference symbols are shown in FIG. 46: SMP stands for a sampling signal, SW161-336 stand for switches 161-336, respectively, and Y1 stands for the output Y1.

When a positive polarity analog picture signal is outputted from Y1 and a negative polarity analog picture signal is outputted from Y2 as the X1 line in the first period shown in FIG. 46, the switch 334 of the switching circuit 33 is switched ON in Y1 as shown in FIG. 46 and as understood from FIG. 39 and FIG. 41. On the other hand, in Y2, the switch 335 is switched ON. At this time, sampling of the analog picture signals outputted as the X2 line is conducted in the sample and hold circuits 16, 26. Thus, at the Y1 side, as shown in FIG. 46, the switch 261 is switched ON and samples and holds the negative polarity analog picture signal. On the other hand, on the Y2 side, the switch 161 is switched ON and samples the positive polarity analog picture signals. At the time of switching from the first period to the second period, the switches 334, 335 are switched OFF for both the Y1 and the Y2, the switch 336 is switched ON and the data line is pre-charged to a GND level.

Switching from the first period to the second period is conducted according to the sampling signal SMP. Synchronization with the sampling signal SMP may be also conducted with respect to pre-charging with the switch 336. If switching is conducted to the second period, as shown in FIG. 46, in the Y1, the switch 335 is switched ON, and in the first period, the sampled negative polarity analog picture signal is outputted. Furthermore, the switch 161 is switched ON and the positive polarity analog picture signal is sampled. In the Y2, the operations are conducted with the inversion of positive and negative polarities. The dot inversion drive is realized by repeating the above-described operations synchronously with the SMP.

Furthermore, the pre-charging voltage was set to a system ground GND, however, it may be also the low-level voltage VPL of the positive polarity drive circuit or a high-level voltage VNH of the negative polarity drive circuit, rather than the system ground GND.

In the present embodiment, the following was set: VPL=VNH=GND. With such a configuration, analog picture signals, rather that n-bit digital picture signals, can be used. Though the number of data lines (data buses) of the n-bit digital picture signals is n, if the D/A conversion is conducted, then analog picture signals on a line are obtained. Therefore, power consumption of the D/A conversion circuits for driving the data lines is 1/n compared to the processing of digital picture signals. Furthermore, because the number of data lines is decreased, the circuitry scale can be reduced.

As described hereinabove, with the present embodiment, it is possible to provide a data line drive circuit device for a liquid crystal display device in which the circuitry scale and power consumption are further decreased.

Embodiment 6

In this embodiment, an example will be described in which the con voltage is set to a voltage value different from GND intentionally, considering the feed-through error occurred at a TFT element. The feed-through error is an error which occurs due to a parasitic capacitor of a gate electrode and through which the variation of the input signal to the gate electrode affects the output signal. Specifically, when the TFT element is changed to the hold state, a scanning signal inputted to the gate electrode from the scanning line 5 affects the voltage of the pixel electrode.

The voltage of a pixel electrode changes according to scanning line voltage variation due to a parasitic capacitor between the gate electrode and the drain electrode (pixel electrode) of a TFT element. This voltage change is the feed-through error. While the reference voltage of the drive circuit and the con voltage are GND in the embodiment 1 through embodiment 5, the com voltage is, when considering the feed-through error, set to a voltage value different from GND to compensate the feed-through error.

Here, since the value of the feed-through error varies from panel to panel, it is necessary to adjust the corn voltage for every panel. Since the feed-through error tends to occur at the negative side for N-type TFT elements, the reference voltage of the drive circuit is set to GND and the corn voltage is set to a DC voltage which is lower than GND and higher than the low voltage of the negative drive circuit. On the other hand, since the feed-through error tends to occur at the positive side for P-type TFT elements, the reference voltage of the drive circuit is set to GND and the corn voltage is set to a DC voltage which is higher than GND and lower than the high voltage of the positive drive circuit. These settings allow the com voltage to compensate the feed-through error occurred at the TFT element. The operation voltages of the data line drive circuit 1 are adjusted in accordance with the con voltage.

For N-type TFT elements, the feed-through error is −1V, the con voltage is −1V, VPH is 5V, VNL is −5V, for example. For N-type TFT elements, the feed-through error is −1V, the corn voltage is 1V, VPH is 5V, VNL is −5V, for example. The adjusting amount of the con voltage for the feed-through error is in .+−.2V range, for example. As most liquid crystal displays uses N-type TFT elements, the liquid crystal display with N-type TFT elements will be described below as an example.

Figure 47:
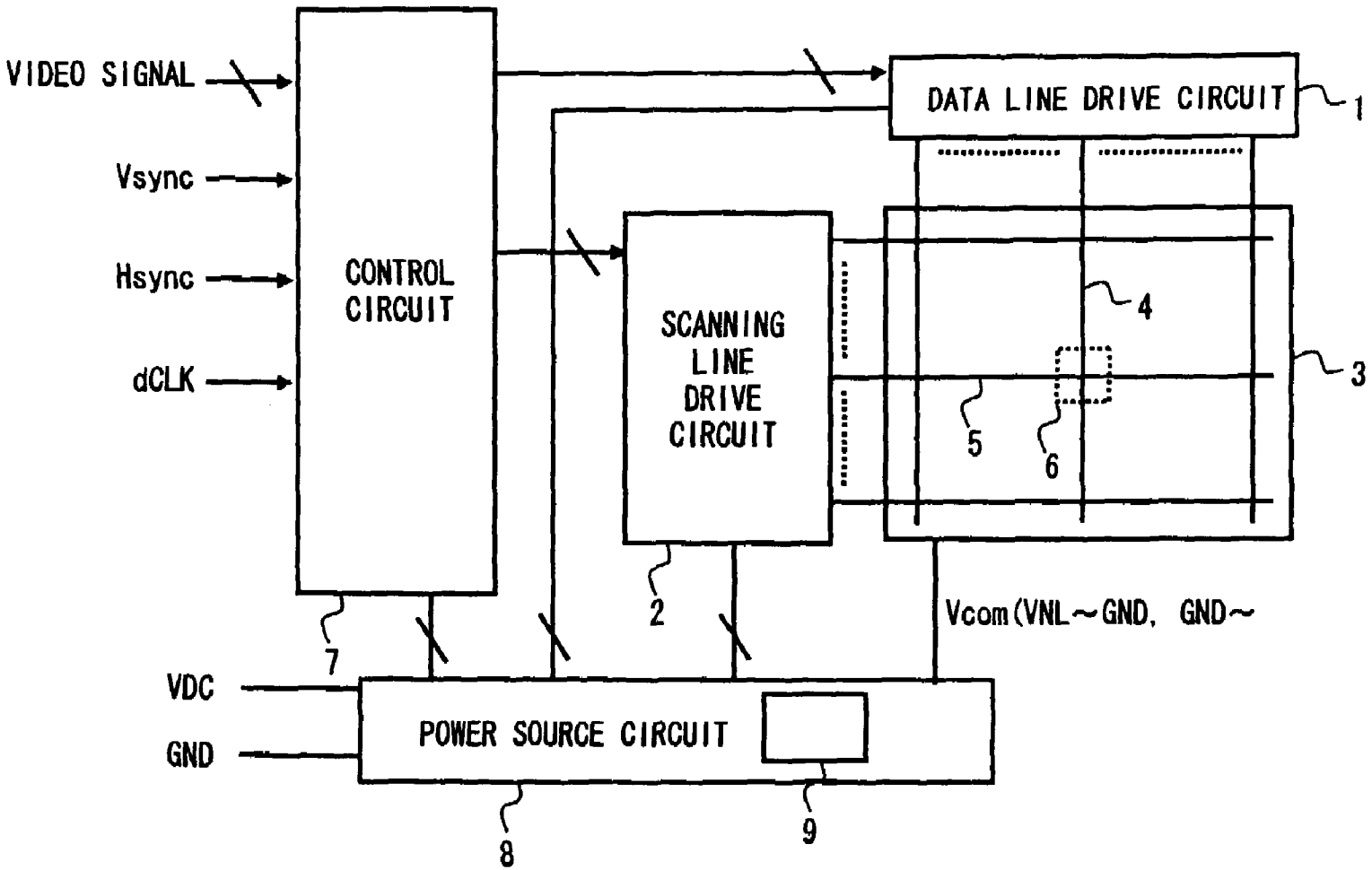
FIG. 47 is a block diagram of the LCD of the sixth embodiment of the present invention.

FIG. 47 is a block diagram of a liquid crystal display according to this embodiment. The data line drive circuit 1 is configured in accordance with one or combination of the embodiment 1 to 5. The power supply circuit 8 has a com voltage generation circuit 9. The power supply circuit 8 may be formed on a substrate the same as or different from the data line drive circuit 1. The con voltage is generated with a buffer circuit and adjusted with a variable resistor or a resistor voltage divider to output the voltage from −2V to +2V. In this case, the buffer circuit must be formed of high voltage elements. Since the voltage required for the com voltage is approximately from −1V to 2V, however, the buffer may operate with GND and the lower voltage of the negative polarity VNL. In this case, it is possible to configure the buffer circuit with middle voltage elements. Though it is difficult for the buffer circuit operating with GND and the lower voltage of the negative polarity VNL to output GND, it is not important if GND is not required for the com voltage. Setting that VPL>GND>com voltage>VNL allows the reduction of the number of step-up operations of DC-DC converter in the power supply circuit and high efficiency of the power supply circuit power consumption.

Figure 48:
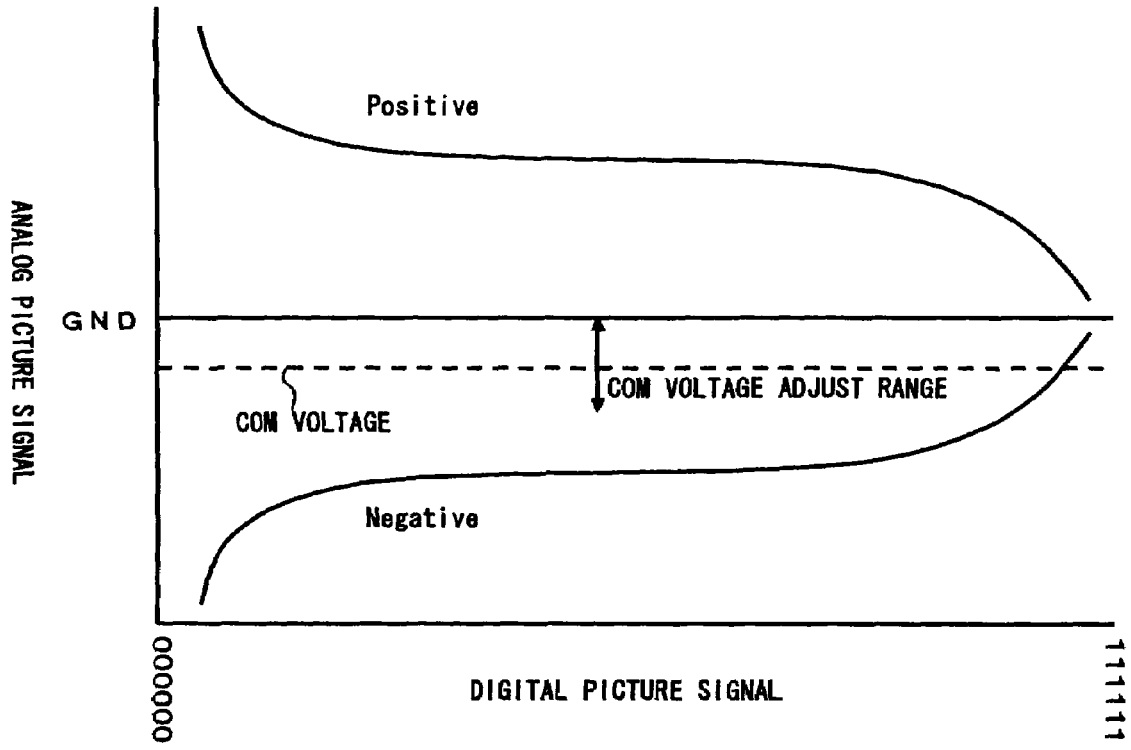
FIG. 48 is a correlation chart of a digital picture signal and an analog picture signal of the sixth embodiment of the present invention.

The con voltage is generated by the com voltage generation circuit 9. The con voltage generation circuit 9 may be configured using a simple circuit consisting of a resistor divider circuit connected between GND and VNL and bypass capacitors connected at nodes between the resistors. The con voltage can be adjusted by changing the resistance of the resistor divider circuit. FIG. 48 depicts a positive polarity gamma curve, a negative polarity gamma curve and the con voltage. The positive polarity gamma curve is set larger than GND. The negative polarity gamma curve is set smaller than GND. The con voltage is adjusted within −1V.+−.1V. This adjusting range is an example. If the con voltage is generated with GND and the lower voltage of the negative polarity VNL, as described earlier, the com voltage may be adjusted in this range. Although the gamma curves are adjusted for each positive and negative polarity in the embodiment 1 because the con voltage is GND, only the com voltage is adjusted, in this embodiment, with the positive and negative gamma curves fixed, improving the convenience.

As describe above, this embodiment can provide a data line drive circuit for a LCD capable of compensating the affection of the feed-through error and limiting the increase of the circuit scale.

It is apparent that the present invention is not limited to the above embodiment and it may be modified and changed without departing from the scope and spirit of the invention. For example, the present invention was explained hereinabove with respect to a data line drive circuit as an example and each circuit can be fabricated on a silicon substrate, a glass substrate, or a plastic substrate.

What is claimed is:

1. A drive circuit for a display apparatus outputting a positive polarity analog picture signal and a negative polarity analog picture signal with respect to a reference voltage to a data line of the display apparatus, comprising:

a positive polarity drive circuit outputting the positive polarity analog picture signal;

a negative polarity drive circuit outputting the negative polarity analog picture signal;

a switching circuit switching the positive polarity analog picture signal and the negative polarity analog picture signal to provide to the data line;

a positive polarity pre-charge switch, formed between the positive polarity drive circuit and the switching circuit, capable of pre-charging the data line to a positive polarity pre-charge voltage before an analog signal provided to the data line is changed from the positive polarity to the negative polarity; and a negative polarity pre-charge switch, formed between the negative polarity drive circuit and the switching circuit, capable of pre-charging the data line to a negative polarity pre-charge voltage before an analog signal provided to the data line is changed from the negative polarity to the positive polarity.

2. The drive circuit of claim 1, wherein the reference voltage is system ground voltage.

3. The drive circuit of claim 1, wherein both the positive polarity pre-charge voltage and the negative polarity pre-charge voltage are system ground voltage.

* * * * *